US006082545A

United States Patent [19]

Ford et al.

[11] Patent Number: 6,082,545

[45] Date of Patent: Jul. 4, 2000

[54] PORTABLE THERAPY AND GAME CASE ASSEMBLY

[76] Inventors: Sherrill A. Ford; Carl D. Ford, Sr., both of 34188 Highway 95 North, Greenback, Tenn. 37742

[21] Appl. No.: 08/839,444

[22] Filed: Apr. 14, 1997

[51] Int. Cl.[7] ..... B65D 43/12; A63F 9/00

[52] U.S. Cl. ..... 206/579; 206/315.1; 220/4.22; 220/520; 273/447

[58] Field of Search ..... 206/315.1, 579; 220/4.21, 4.27, 345, 346, 504, 520, 4.22; 273/282.1, 289, 429, 447; 434/84, 322, 348

[56] References Cited

U.S. PATENT DOCUMENTS

| | | | |
|---|---|---|---|
| D. 247,441 | 3/1978 | Kroll | D19/36 |
| D. 255,588 | 6/1980 | McAusland | D21/20 |
| D. 256,480 | 8/1980 | Wright | D19/75 |
| D. 332,466 | 1/1993 | Logan | D19/36 |
| D. 354,920 | 1/1995 | Moradinia | D10/46.1 |
| D. 356,334 | 3/1995 | Kroop et al. | D19/36 |
| D. 361,621 | 8/1995 | Johnson | D24/188 |
| 3,693,976 | 9/1972 | Flack | 273/131 BA |
| 3,710,455 | 1/1973 | Liversidge et al. | 35/22 A |
| 4,163,559 | 8/1979 | Stenstrom | 273/148 |
| 4,311,465 | 1/1982 | Jacobs | 434/157 |
| 5,056,793 | 10/1991 | Sigle | 273/282 |
| 5,288,075 | 2/1994 | Kelley | 273/243 |
| 5,482,295 | 1/1996 | Phelan | 273/459 |

OTHER PUBLICATIONS

Sammons Preston Catalong, 1996, p. 300.

Sammons Preston ABC Catalog, 1996, p. 44.

Sammons Catalog, 1994, p. 115.

Sammons Preston Catalog, 1996, p. 126.

Smith & Nephew Rolyan® Catalog, 1995, p. 169.

Concepts ADL 1995 Catalog, p. 53.

Flaghouse 1995 Catalog, pp. 38 and 122.

*Primary Examiner*—Jimmy G. Foster

*Attorney, Agent, or Firm*—M. Alex Brown, Esq.

[57] ABSTRACT

A Self-contained, portable therapy and game case assembly having sliding and opening sections and compartments and portions of the therapy assembly which can be utilized together or separately is disclosed. The therapy assembly is provided for use with various symbolized or illustrated inlay and sliding sheets, for testing and prompting selected skills and associative thinking. The invention is provided as a coupled and portably transportable first and second subassemblies. The first subassembly is provided from outside or outboard to inside or inboard, when in assembled position, with a first sliding feature which recieves a sliding first transparent sliding member; a symbolized inlay sheet; a feature for securing a stationary member which receives an erasable board member; a dividing storage area secured adjacent and inboard or inside of the erasable board member; and a second sliding feature which receives a second transparent sliding member so that it can be positioned inside the divided storage area as a cover. The second subassembly is provided, outboard to inboard with a sliding feature which recieves one or more peg-board sheets; a first feature for stationary securement receiving a pivotable and symbolized multiple-door unit; second stationary feature receiving a transparent sheet; slot feature receiving a symbolized sheet; and a third stationary feature receiving an inboard wall panel.

18 Claims, 26 Drawing Sheets

PORTABLE THERAPY AND GAME CASE ASSEMBLY

BACKGROUND OF THE INVENTION

1. Field of the Invention

The invention relates to a portable apparatus or device for therapeutically testing the hand, eye and cognitive identification and related skills of a patient or user, and to such a device having sliding and opening sections and compartments for such a use.

2. Background Information

Typical of the prior art references related to games and educational devices to test or bring about cognition, identification, sensory-motor skills, hand and eye therapy and coordination, speech and communication and hand therapy are U.S. Pat. Nos. to: Phelan (5,482,295); Langstroth (5,344,154); Kelly (5,288,075), Sigle (5,056,793); Jacobs (4,311,465); Stenstrom (4,163,559); Liversidge et al. (3,710,455); Flack (3,693,976); Johnson (Des. 361,621); Kroop (Des. 356,334); Moradinia (Des. 354,920); Logan (Des. 332,466); Shoptaugh (Des. 295,055); Wright (Des. 256,480); McAusland (Des. 255,588); Kroll (Des. 247,441); located during a patent search; and published material appearing in the Sammons Preston 1994 and 1996 Catalog, pages 115 ('94), 126 and 300 ('96), relating to Sidiki Transparent Writing/Activities Table and Programs and Activity Boards; Sammons Preston ABC Catalog 1996, page 44, relating to Sidiki Portable Transparent Writing table and Programs; Smith and Nephew Rolyan® Home Activity Simulator and Easel devices; Concepts ADL 1995 Catalog, page 53, relating to Manipulation Board, String Drawing Board and Activity Boards; and the Flaghouse 1995 Catalog, pages 38 and 122, relating to Table-Top Quiet Activity Center and Uffwood Activity Package, Shape boards, Geoform Boards, Sorter Puzzles and Giant Lock Memory-Box.

the Phelan '295 patent reference discloses and claims a round robin drawing game board presenting six doors for exposing parts of a drawing underneath for the purpose of instructing young children in drawing parts of the human body. The Kelly '075 patent discloses an image recognition game apparatus and game playing method, utilizing a revealing device having shutters each of which is slidable between open and closed positions incrementally revealing a face card inserted within the device, with the opening of the shutters being determined by movement of game pieces on a gameboard. The Sigle '793 patent discloses a picture identification game apparatus for competitively determining the identity of a partially exposed picture initially concealed with separately identified opaque cover pieces removably secured on to a protective window superimposed in front of the picture to be identified by a group of competing participants. The Jacobs '465 patent discloses a translator device for translating between an understood language and a foreign language, comprising a number of juxtaposed columns with each column slidably receiving a plurality of individual cards, with the columns being organized in a sequential, semantic, or syntactic relationship in order that a language student may select components by sliding up the top card, from two or more columns to effect larger grammatical meanings such as sentences. The back of each preceding card contains the translation of the exposed grammatical structure and is viewed by flipping the translator device over to read the translated material directly.

The Stenstrom '559 reference discloses a compartmented card game box kit with removable drawer, having a bottom divided into separate compartments for a deck of cards, kitty and play money; and a top package having indicia thereon to facilitate its use as a playing board for travel and to serve as a display sales package for the game and its accessories. The Liversidge et al. '455 patent discloses an electical education game device, provided with a housing with an upper face having a number of aperatures, of geometrical, alphabetical, numerical, animal, bird or other shapes, into which matching game pieces can be inserted. Within the housing of the Liversidge device a spring impelled plate, controlled by an adjustable timer is provided to discharge the pieces at the end of a predetermined selected time interval.

The Flack '976 reference represents an example in a very crowded art of devices utilizing peg-board game apparatus and like structure to achieve a game purpose or activity. The Flack device is based on the teaching of providing a unit pair of pegs fitting in the holes of the board and joined by a flexible chord member which acts to limit the ambit of movement of the pegs relative to each other to the distance between alternate holes on a diagonal line. The Johnson design patent '621 discloses an ornamental design for what appears to be a partial peg-board and insertable peg pieces for constituting a hand therapy board. Other similar devices are disclosed in the McAusland design patent '588, Kroll design '441, Kroop et al. design '334, Moradinia design '920 and Shoptaugh design '055; relating, respectively to a board game unit, a child's portable drawing, game and play box, a writing surface and container for supplies, a combined game board and container, and a combined gameboard, game pieces and container therefor.

The Logan design patent '466 and the Wright design '480 relate, respectively, to a combined multi-paneled easel and art display case and a storage box with sliding lids.

The first group of published catalog references (Sammons Preston) relates to a transparent writing/activities table disclosed for use as a blackboard, flannelboard or an adjustable activities table, and describing four grooves for a mirror insert, a plexiglass insert and a rear projection insert. Also disclosed in these catalogs is a depth perception peg board set, an adjustable activity peg board and an activity tray. The Smith & Nephew Rolyan® 1995 Catalog discloses cognitive-perceptual easel with a positionable peg board and a home activity simulator illustrating common locks, handles, switches and plugs mounted on a plastic form. The Concepts ADL 1995 Catalog illustrates a manipulation board vertically mounted on support legs, and simply having common household locks, latches and water valve mounted on a board to stimulate hand and finger activity and ADL rehabilitation. Also illustrated is a string drawing peg-board and activity boards with telescoping legs and depth-adjustable front legs. The Flaghouse 1995 Catalog illustrates a table-top quiet activity center providing a display board with four (4) different eye-hand-sound activities and a tilting activity package accommodating four drop-in modules: (1) push-button lights and sounds, (2) noisy, bouncing springs, (3) toy electric keyboard and (4) holographic mirror mounted on spinner. Other devices illustrated in this catalog include hand-grip shape boards, hand-grip sorter puzzles, geoform boards having insertable and gripable circle, square, rectangle and triangle pieces, and a giant lock memory box providing on a box various locks to be manipulated and an opening for storage inside the box in three internal compartments when a given lock or latch is successfully negotiated.

None of the references found specifically illustrates or teaches the portable therapy and game case assembly of the present invention. Nor is the present invention obvious in view of any of the prior art references listed. In addition, all of the relevant prior art heretofore known suffer from a number of disadvantages.

None of the apparently crowded, prior art references teach concepts within a portable, self-contained therapy case assembly unit which structurally coordinate pivotal, dowel-hinged, revealing door members, transparent overlay, removable storage compartments, full and partial removable peg-board members, and hand-therapy shaped door handles and various insertable symbol sheets and separate drop-in inlay sheets; to accomplish functionally the therapeutic and game options of the present invention. Nor do the prior art references address the functional capability of providing the breath and diversity of the therapeutic and game options for testing cognition, hand and eye coordination and sensory-motor skills in one portable, user-friendly case assembly. The prior art references are each bulky and/or structurally limited to one or two testing options; and, in many cases somewhat dangerous, uncomfortable and inefficient or clumsy or awkward to use.

These and other disadvantages, structurally and functionally, of the prior art will become apparent in reviewing the remainder of the present specification, claims and drawings.

Accordingly, it is an object of the present invention to provide a substantially improved and more efficient portable therapy and game case assembly having optionable boards, multiple door panel, partial and total peg board means, white or other-colored dry-erase board and clear-write, on-wipe-off or like board, with a releasable and movable framed, compartmented, internally provided storage area to carry extra slide-in sheets, pencils, eraser, game tokens and other therapeutic or game items, and having a self-contained board with all of its other self-contained features which is adjustable to several appropiate angles and positions.

It is a further object to provide a therapy-to-go, self-contained therapeutic case assembly ahving a panel with multiple pivotable and hinged doors provided with a diverse array of knobs and pullable configurations to test the ability to recognize different grasping skills and prompt various fine motor skills and components. Related to this is the object of the invention in providing different activity sheets which can be slid under the selected doors on the panel to create many memory problems to be solved in a therapeutic or game context, and many ways and combinations in which different and slidable sheet and inlay members, together with the door handles can be used in comparison and in combination with one another to test various association skills.

It is a further object to provide within the same self-contained, portable assembly a sliding peg board which is utilized to improve eye-hand coordination, visual discrimination and fine-motor control, or be utilized with patterns to develop visual and spatial discrimination. An additional advantage of the invention is achieved in having on the opposite side of the case assembly, from the peg board component and door panel and shelf component, a white or differentially colored dry-erase board for use in free hand drawing or writing practice; and, with this sturcture, a clear or transparent plastic insert (or other material) which fits over the white board, with a space in-between, to facilitate sliding in sheets calling for various activities, such as tracing letters and numbers and following a maze or dot-to-dot picture, among other diverse activities and drills or practice to test skills.

It is yet a further object to provide pivotable, dowel-hinged or other pivotable means, with these doors having pulls, knobs and handles which will prompt and require motor skills such as the three-jaw grasp, hook, lateral pinch and tip pinch; and providing for use with the self-contained assembly tokens, markers and eraser for improving in-hand manipulation. An additional advantage and object of the invention is achieved by grading the activities by limiting the number of doors on the panel for use and by selecting a slide-in sheet for use with the therapy assembly from simple to complex.

It is a further object of the invention to provide a diverse therapeutic, self-contained portable case assembly which prompts and tests diverse sensory integration skills, including tactile-proprioceptive-vestibular functions such as postural adjustments and coordinated use of both body sides, and graded motor-planning skills; visual function such as visual scanning to match items, for writing, and for tracing, recognition of different colors, sizes and shapes all within the same self-contained unit assembly, and activities requiring fitting parts, matching, fitting shapes, and differentiating patterns; hearing activities essential to using the diverse functions of the therapy assembly; and cognitive demands, graded in nature, for reading, writing, speaking, and understanding instructions.

It is an additional object of the invention to provide a portable therapy case assembly with improved safety factors, such as in reducing the likihood of the danger of cutting, piercing or burning the skin of a user, or of losing control of equipment options causing injury.

Yet an additional object of the present invention is to enhance solitary or interpersonal use and activities; and to address important therapeutic objectives, functionally and structurally, such as physical objectives in refining fine-motor skills; sensory-integrative objectives in improving memory skills, eye-hand coordination, visual and spatial discrimination and attention span; psychosocial objectives in improving self-esteem and interaction skills, reducing anxiety and providing an outlet for self expression; and vocationally related objectives such as increased skills in memory, attention and fine-motor skills.

It will, therefore, be understood that substantial and distinguishable structural and functional advantages are realized in the present invention over the prior art devices and methods.

SUMMARY OF THE INVENTION

The foregoing and other objects of the invention can be achieved with the present invention device, system and assembly which is a self-contained, portable therapy and game case assembly. The invention is provided for use with various symbolized or illustrated inlays and sliding sheets for testing and prompting selected skills and thinking of a user; and includes a first section subassembly having a generally rectangular sidewall support which has generally parallel first and second side members and third and fourth side members positioned and connected generally parallel to one another and transverse to the first and second side members, and defining and having therewithin a hollow outboard installation space, middle-portion space and inboard installation space, each coextensive with one another.

The sidewall support of the first section subassembly has a first sliding means proximal to the outboard installation space for receiving a sliding member, a means for securing a stationary member positioned between the first sliding means and the hollow middle-portion space, and a second sliding means proximal to the inboard installation space for receiving a a sliding member.

The first section subassembly of the invention is further provided with a first transparent sliding member which is slidably engaged, installed and supported by the first sliding means; an erasable board member having first and second surfaces, and being fixedly secured within the means for securing a stationary member such that the first surface lies below and is viewable through the first transparent sliding member; a dividing means for providing storage space which is mounted adjacent to the second surface of the erasable board member within and adjacent to the hollow middle-portion space and the hollow inboard installation space; and a second transparent sliding member which is slidably engaged, installed and supported by the second sliding means so that it slidably covers the dividing means.

The present invention is further provided with a second section subassembly having a generally rectangular sidewall support which is provided with generally parallel first and second side members and third and fourth side members positioned and connected generally parallel to one another and transverse to the first and second side members, and defining and having therewithin a hollow outboard installation space, middle portion space and inboard installation space, each coextensive with one another.

The sidewall support of the second section subassembly has a sliding means positioned proximal to the outboard installation space for receiving a sliding member, first means for securing a stationary member positioned proximal to the hollow middle-portion space, second means for securing a stationary member positioned below or under the first means between the middle-portion space and the inboard installation space, slotable means inboard of the second means for receiving a sliding symbolized sheet member and third means for securing a stationary member positioned adjacently between the slotable means and the hollow inboard installation space.

The second section subassembly of the invention is further provided with a sliding support surface defining and having a plurality of insertion installation holes which is slidably engaged, installed and supported on the sliding means; a door frame support member having an outboard surface and an inboard surface and having a plurality of movable doors mounted therebetween, which is secured within the first means for securing a stationary member, and which is provided with each of the movable doors having a symbolized handle member; a stationary transparent member, secured within the second means for securing a stationary member such that it is adjacent to the inboard surface of the door frame support member; and a substantially solid and resistent inboard wall section panel, secured in stationary position within the third means for securing a stationary member.

The portable therapy case assembly is further provided with means for coupling the first section subassembly of the invention; and a plurality of corner support members for reinforcing and supporting the connection of the first, second, third and fourth side members of the first section subassembly and the first, second, third and fourth side members of the second section subassembly of the invention.

REFERENCE NUMBERS IN DRAWINGS

Figure 1:
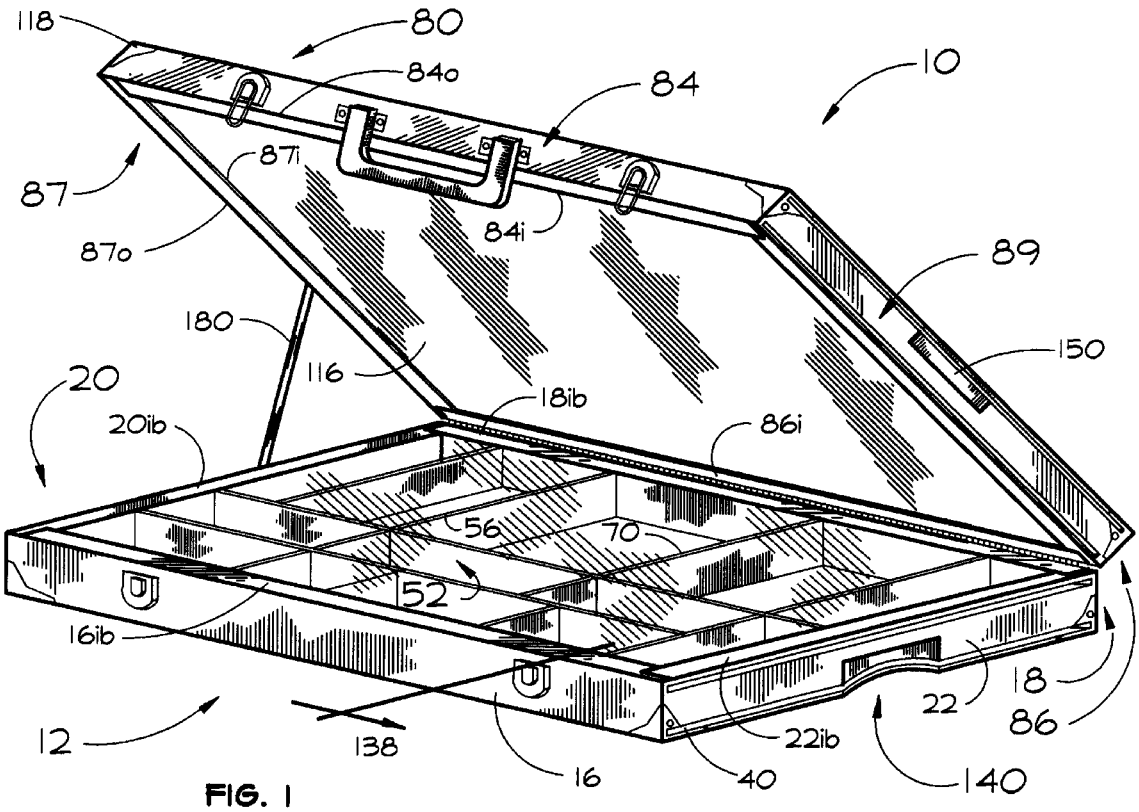
FIG. 1 is a perspective view of a preferred embodiment of the novel portable therapy and game case assembly of the present invention.

| | |
|---|---|
| 10 | portable therapy and game case assembly (therapy assembly) |
| 12 | first section subassembly |
| 14 | sidewall support of (12) |
| 16 | first side member of (14) |
| 18 | second side member of (14) |
| 20 | third side member of (14) |
| 22 | fourth side member of (14) |
| 23 | installation area of (14) |
| 24 | hollow outboard installation space of (14) |
| 26 | hollow middle-portion space of (14) |
| 28 | inboard installation space of (14) |
| 30 | first sliding means system of (14) |
| 32 | fixed means for securing a stationary member of (14) |
| 16i | inside lengthwise surface of (16) |
| 18i | inside lengthwise surface of (18) |
| 20i | inside lengthwise surface of (20) |
| 22i | inside lengthwise surface of (22) |

-continued

REFERENCE NUMBERS IN DRAWINGS

| | |
|---|---|
| 16o | outside lengthwise surface of (16) |
| 18o | outside lengthwise surface of (18) |
| 20o | outside lengthwise surface of (20) |
| 22o | outside lengthwise surface of (22) |
| 16ob | outboard widthwise surface of (16) |
| 18ob | outboard widthwise surface of (18) |
| 20ob | outboard widthwise surface of (20) |
| 22ob | outboard widthwise surface of (22) |
| 16ib | inboard widthwise surface of (16) |
| 18ib | inboard widthwise surface of (18) |
| 20ib | inboard widthwise surface of (20) |
| 22ib | inboard widthwise surface of (22) |
| 16e' and 16e" | connecting end-portions of (16) |
| 18e' and 18e" | connecting end-portions of (18) |
| 20e' and 20e" | connecting end-portions of (22) |
| 22e' and 22e" | connecting end-portions of (22) |
| 30a | guide slot or channel of (16i) of (16) |
| 30b | guide slot or channel of (18i) of (18) |
| 30c | guide slot or channel of (20i) of (20) |
| 30d | guide slot or channel of (22i) of (22) |
| 32a | side attachment slot of (32) of (16i) |
| 32b | side attachment slot of (32) of (18i) |
| 32c | end attachment slot of (32) of (20i) |
| 32d | end attachment slot of (32) of (22i) |
| 40 | first transparent sliding member |
| 41 | installation of (40) on to (30) |
| 40' | first surface of (40) |
| 40" | second surface of (40) |
| 40a | first side section of (40) |
| 40b | second side section of (40) |
| 40c | first end section of (40) |
| 40d | second end section of (40) |
| 42 | erasable board member |
| 42' | first surface of (42) |
| 42" | second surface of (42) |
| 50 | dividing means construction |
| 52 | dividing section members of (50) |
| 54 | installation surface of (52) |
| 56 | exposed surface of (52) |
| 58 | section member grooves |
| 60 | second sliding means of (14) |
| 60a | slidable slot of (16i) and (60) |
| 60b | slidable slot of (18i) and (60) |
| 60c | end slot of (20i) and (60) |
| 60d | installation slot of (22i/22o) and (60) |
| 70 | second transparent sliding member |
| 60a' | axis of the slidable slot (60a) |
| 60b' | axis of the slidable slot (60b) |
| 70c | one of the end portions of (70) |
| 70d | another end portion of (70) |
| 80 | second section subassembly of (10) |
| 82 | shelf matrix of (80) |
| 84 | first side member of (82) |
| 86 | second side member of (82) |
| 87 | third side member of (82) |
| 89 | fourth side member of (82) |
| 84i | inside surface of (84) |
| 84o | outside surface of (84) |
| 86i | inside surface of (86) |
| 86o | outside surface of (86) |
| 87i | inside surface of (87) |
| 87o | outside surface of (87) |
| 89i | inside surface of (89) |
| 89o | outside surface of (89) |
| 90 | outboard installation space of (82) |
| 92 | middle-portion space |
| 94 | inboard installation space |
| 96 | sliding means of (82) |
| 98 | first means for securing a stationary member of (82) |
| 100 | second means for securing a stationary member of (82) |
| 102 | slotable means of (82) |
| 104 | third means for securing a stationary member of (82) |
| 106 | sliding support surface of (80) |
| 106a | support surface holes of (106) |
| 108 | door frame shelf support member of (82) |
| 108o | outboard surface of (108) |
| 108i | inboard surface of (108) |

-continued

| REFERENCE NUMBERS IN DRAWINGS | |
|---|---|
| 110 | positionable door members of (108) |
| 112 | symbolized identification handle members of (110) |
| 114 | stationary transparent member of (80) |
| 116 | inboard wall panel of (80) |
| 118 | support bracket means |
| 120 | means for portably transporting |
| 96a | guide slot of (84i) |
| 96b | guide slot of (86i) |
| 96c | guide slot of (87i) |
| 96d | insertion slot through (89i/89o) |
| 98a | attachment slot of (84i) |
| 98b | attachment slot of (86i) |
| 98c | attachment slot of (87i) |
| 98d | attachment slot of (89i) |
| 102a | sheet guide flange portion of (84i) |
| 102b | sheet guide flange portion of (86i) |
| 102c | sheet guide flange portion of (87i) |
| 102d | sheet insertion channel of (89i/89o) |
| 130 | symbolized sheet |
| 108a | door openings of 108 |
| 109a | dowel support portion |
| 109b | doorjamb or doorpost portion |
| 11a | dowel hinge installation channel |
| 110a | first dowel support channel |
| 110b | second dowel support channel |
| 113 | dowel member |
| 104a | inboard wall attachment channel of (104) and (84i) |
| 104b | inboard wall attachment channel of (104) and (86i) |
| 104c | inboard wall attachment channel of (104) and (87i) |
| 104d | inboard wall attachment channel of (104) and (89i) |
| 140 | first finger notch space portion of (14) |
| 150 | second finger notch space portion of (82) |
| 160 | first selectable prop channels of (20o) |
| 170 | second selectable prop channels of (87o) |
| 180 | prop support member |
| 117 | hingeable means |
| 119 | clasp means |
| 200 | symbolized and illustrated inlay sheet member |

DETAILED DESCRIPTION OF THE PREFERRED EMBODIMENTS OF THE INVENTION

The following description of the preferred embodiments of the concepts and teaching of this invention is made in reference to the accompanying figures.

Referring now to the drawings, FIGS. 1, 2, 3, 4A, 4B, 5A, 5B, 6A, 6B, 7A, 7B, 8, 9A, 9B, 10A, 10B, 11A, 11B, 12A, 12B, 13, 14, 15, 16, 17, 18, 19, 20, 21, 22, 23, and 29, 30 and 32, therof there is shown a portable therapy and game case assembly 10, of the present invention, hereinafter referenced as a therapy assembly 10, for use with symbolized inlays and slidable sheets for testing and prompting selected skills and thinking of a patient, user or participant, as herein described.

The therapy assembly 10 is provided with a first section subassembly 12 having a sidewall support 14 which is preferably, generally rectangular in configuration, but which can be provided in many diverse configurations within the spirit of the invention as those skilled in the art will recognize.

The sidewall support 14 is provided in a preferred embodiment of the invention with four side members, including first side member 16, second side member 18, third side member 20 and fourth side member 22. The first and second side members, 16 and 18, respectively, are attached to the third and fourth side members, 20 and 22 so that they are positioned generally parallel to each other, and are transverse or perpendicularly positioned when connected to the third and fourth side members, 20 and 22; as illustrated in FIGS. 1, 2, 3, 29, 30 and 32. By attachment in this manner in one preferred positional configuration of the invention the side members 20 and 22 are parallel to each other and transverse or perpendicular to the side members 16 and 18 of the sidewall support 14, as illustrated. When so connected the side members 16, 18, 20 and 22 of the sidewall support 14 have, create and define installation area 23 having hollow outboard installation space 24, outer-oriented positionally; middle-portion space 26, centrally-oriented positionally; and inboard installation space 28, inner-oriented positionally; each of which is connected and coextensive with one another as illustrated in FIGS. 3 through 7.

Each of the side members, first, second, third and fourth, 16, 18, 20, and 22 respectively; has an inside lengthwise surface, 16*i*, 18*i*, 20*i* and 22*i* respectively; and outside lengthwise surface, 16*o*, 18*o*, 20*o* and 22*o* respectively; an outboard widthwise surface 16*ob*, 18*ob*, 20*ob* and 22*ob* respectively; an inboard widthwise surface, 16*ib*, 18*ib*, 20*ib* and 22*ib* respectively; and oppositely positioned, paired connecting-end portions, 16*e*', 16*e*"; 18*e*', 18*e*"; 20*e*', 20*e*"; and 22*e*', 22*e*"; respectively. These elements of the invention are illustrated by example in FIGS. 1, 2, 3, 4A, 4B, 5A, 5B, 6A, 6B, 7A, 7B, and 14 through 19.

Figure 3:
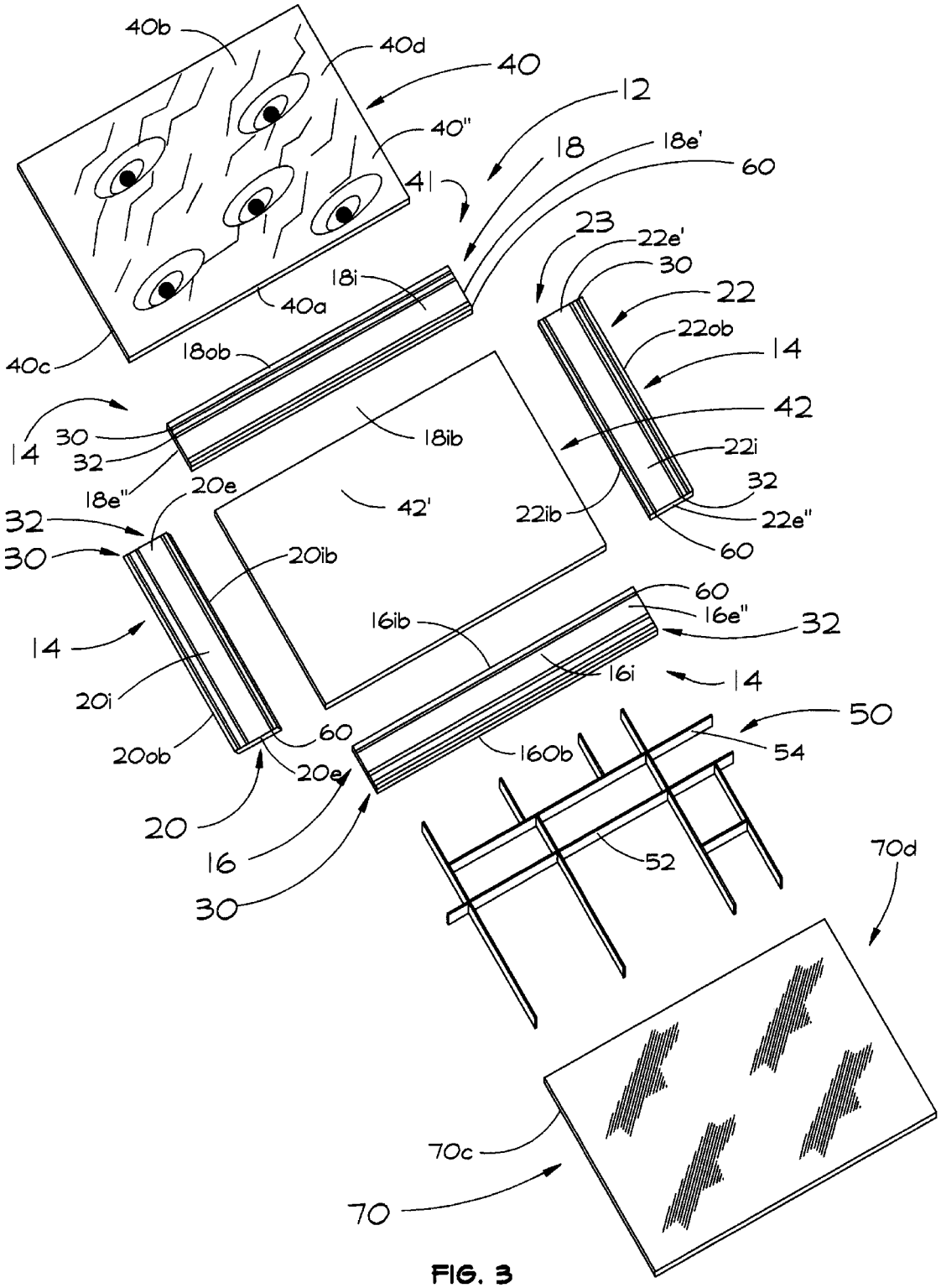
FIG. 3 is an exploded view of first section subassembly of the invention.
Figure 4A:
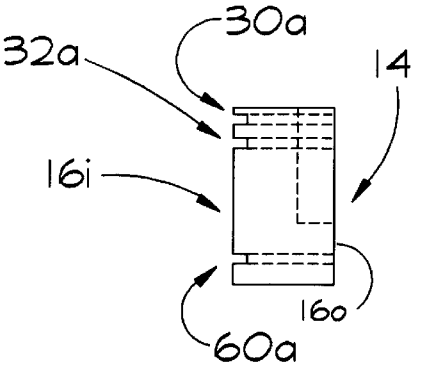
FIG. 4A is a side view of one of the long side members of the first section subassembly of the invention
Figure 5A:
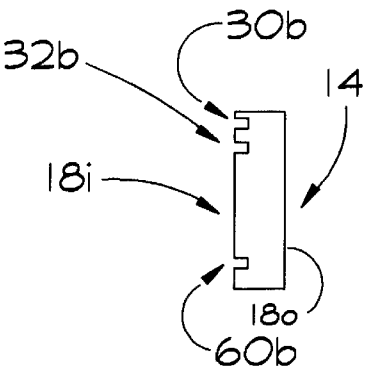
FIG. 5A is a side view of another of the long side members of the first section subassembly of the invention.
Figure 4B:
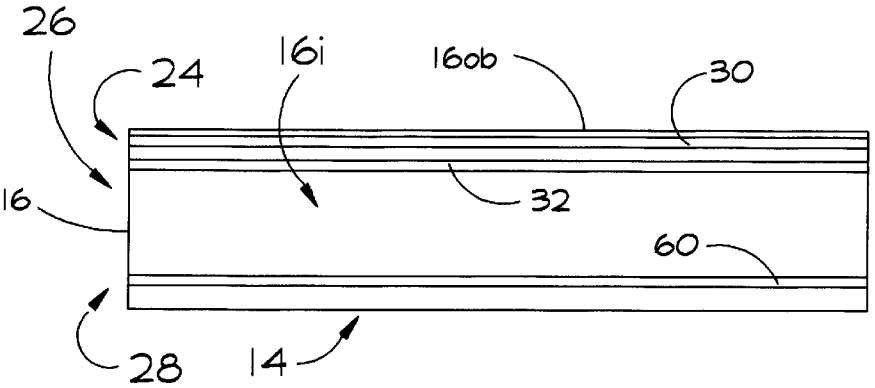
FIG. 4B is an inside front view of the side member of FIG. 4A.
Figure 5B:
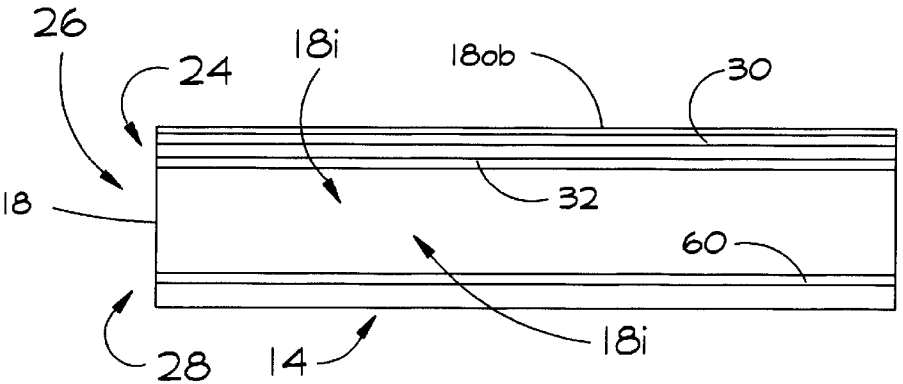
FIG. 5B is an inside front view of the of the side member of FIG. 5A.

In one preferred embodiment of the invention, as illustrated in FIG. 3, the connecting end-portions of each of the side members; 16, 18, 20 and 22 respectively; is securely connected to one another so that the following end-portion pairings occur for connection of each of the side members to one another: 20*e*'-16*e*'; 16*e*"-22*e*"; 22*e*'-18*e*'; and 18*e*"-20*e*"; as illustrated. In connecting the side members 16, 18, 20 and 22 in this pairing the side members are positionally oriented as illustrated and indicated earlier herein, so that the first and second side members, 16 and 18 are positioned generally parallel to one another; the first side dmember 16 is generally transversely or perpendicularly positioned relevant to the connecting third side member 20 at one end and the connecting fourth side member 22 at the other end; the third and fourth side members 20 and 22, are generally parallel positionally to one another; and the second side member 18 is generally transversely positioned relevant to the connecting third side member 20 at one end and the connecting fourth side member 22 at the other end; as illustrated.

The sidewall support 14 is further provided with a first sliding means system 30 wwhich is located, positionally, proximal or close to the outboard installation space 24 on or adjacent to each side member, 16, 18, 20 and 22, and is utilized for receiving a sliding member, later described herein. The support 14 also has a fixed means for securing a stationary member 32, described later herein, which is positioned between the first sliding means 30 and the middle-portion space 26 within the installation area 23 inside the sidewall support 14.

Figure 6A:
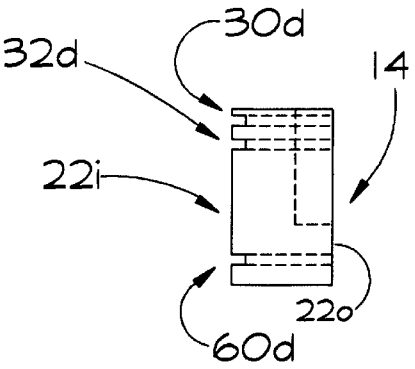
FIG. 6A is a side view of one of the short side members of the first section subassembly of the invention.
Figure 7A:
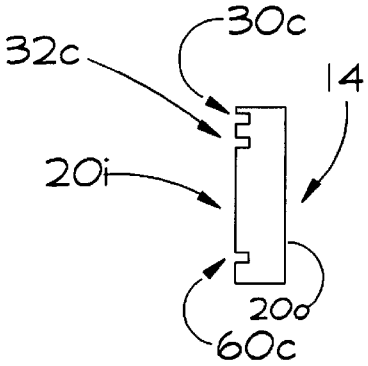
FIG. 7A is a side view of another of the short side members of the first section subassembly of the invention.
Figure 6B:
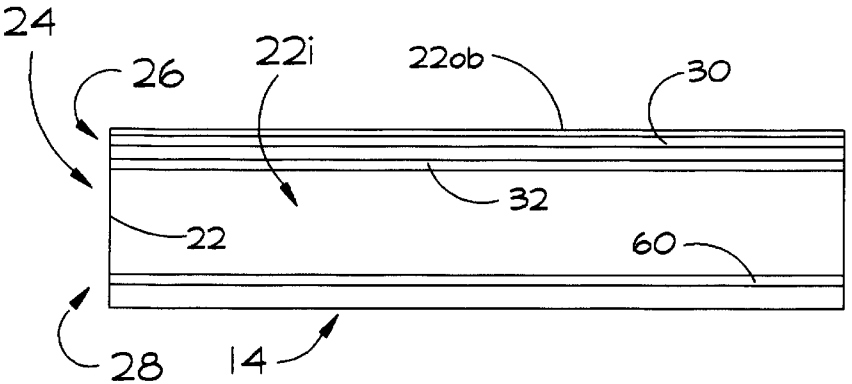
FIG. 6B is an inside front view of the side member of FIG. 6A.
Figure 7B:
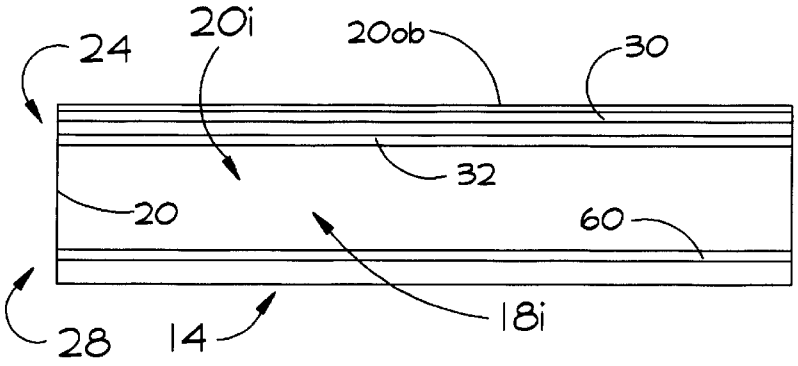
FIG. 7B is an inside front view of the side member of FIG. 7A
Figure 8:
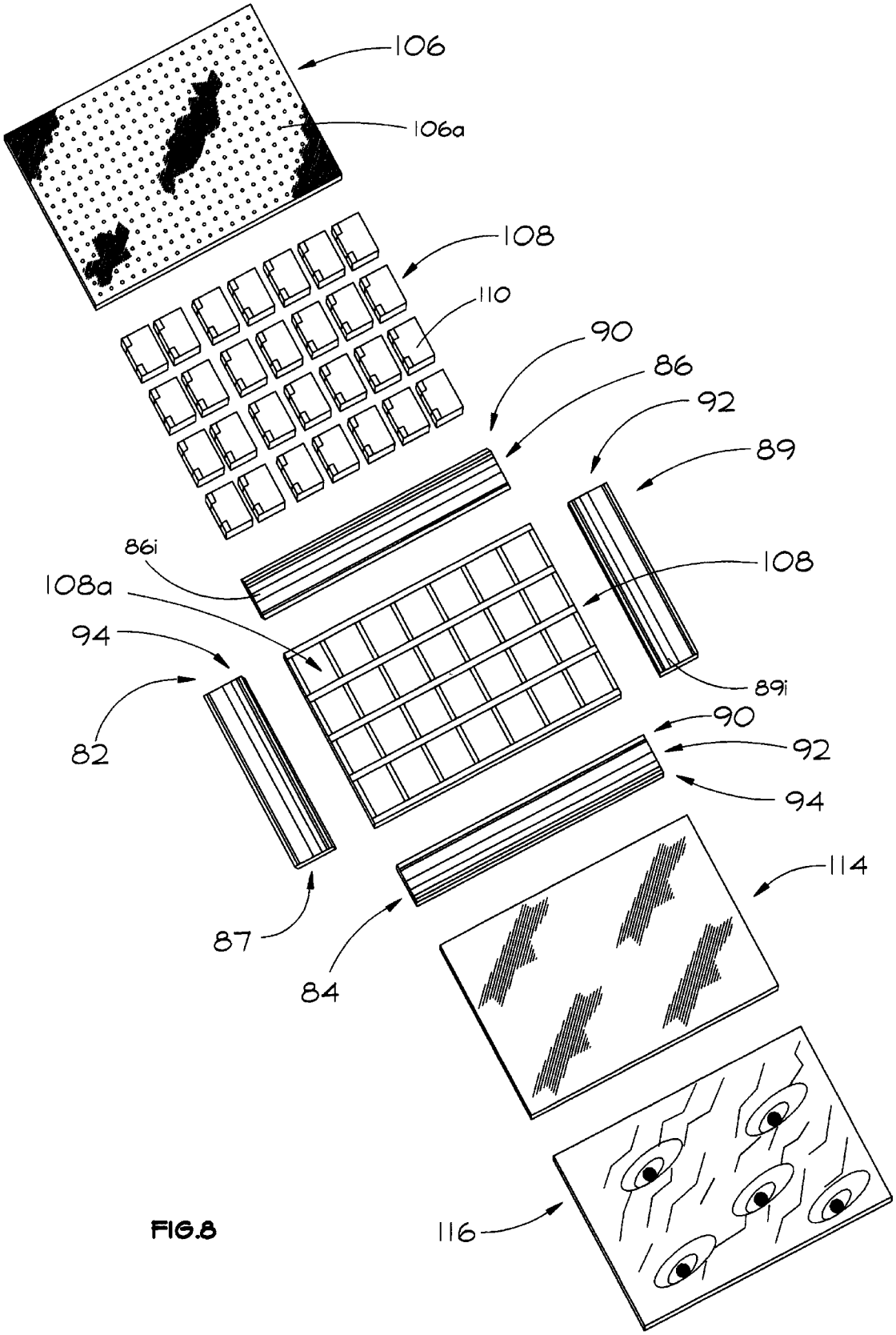
FIG. 8 is an exploded view of the second section subassembly of the invention.
Figure 9A:
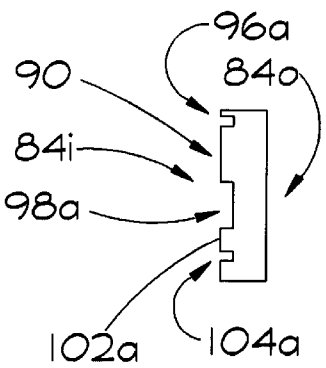
FIG. 9A is a side view of one of the long sidemembers of the second section subassembly of the invention.
Figure 9B:
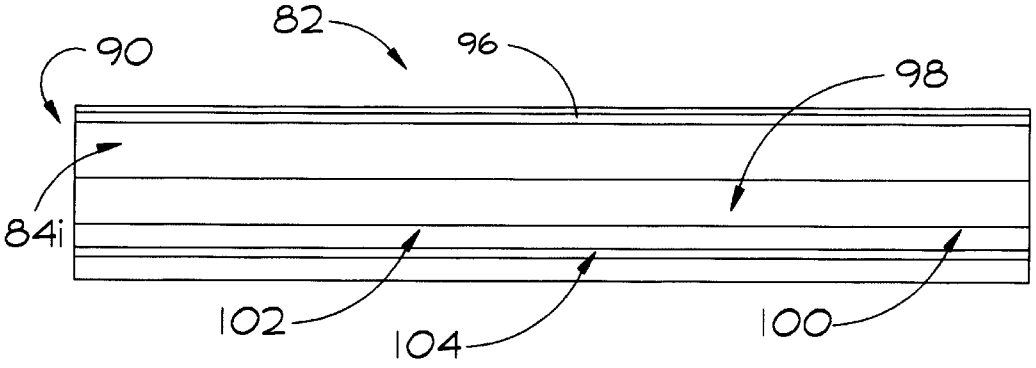
FIG. 9B is an inside front view of the side member of FIG. 9A.
Figure 10A:
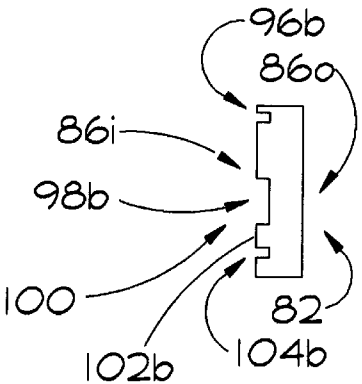
FIG. 10A is a side view of another of the long side members of the second section subassembly of the invention.
Figure 10B:
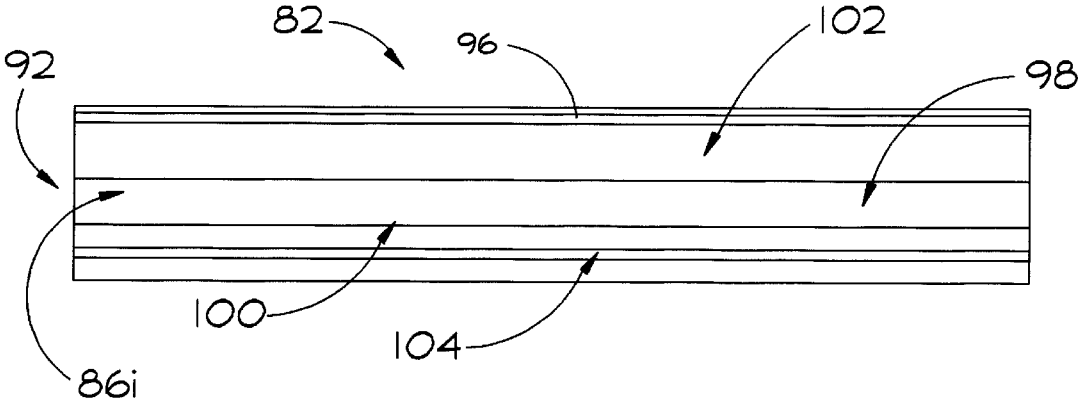
FIG. 10B is an inside front view of the side member of FIG. 10A.
Figure 11A:
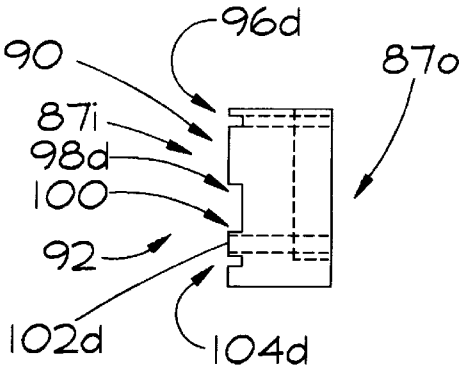
FIG. 11A is a side view of one of the short side members of the second section subassembly of the invention.
Figure 12A:
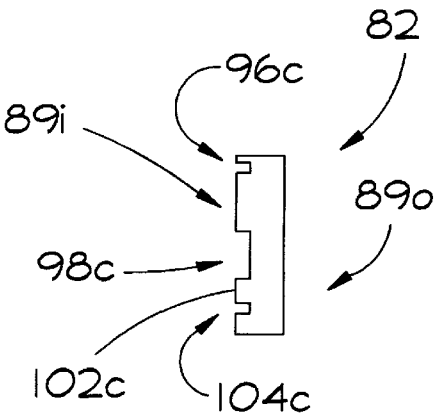
FIG. 12A is a side view of another of the short side members of the second section subassembly of the invention.
Figure 11B:
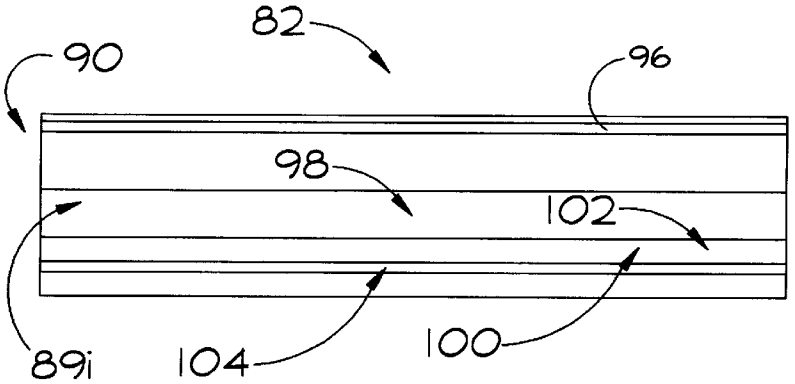
FIG. 11B is an inside front view of the side member of FIG. 11A.
Figure 12B:
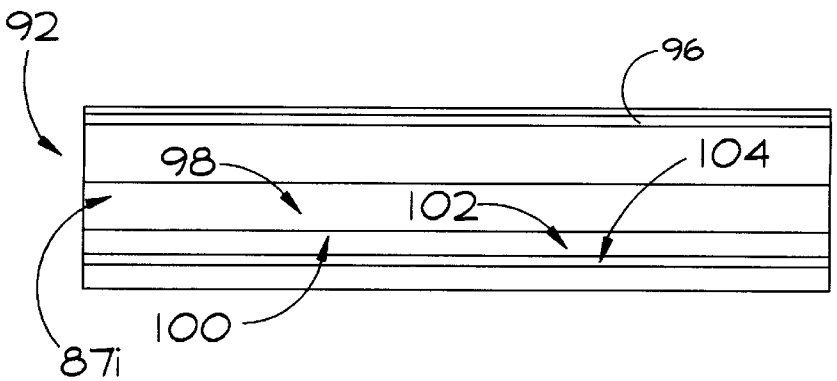
FIG. 12B is an inside front view of the side member of FIG. 12A.
Figure 13A:
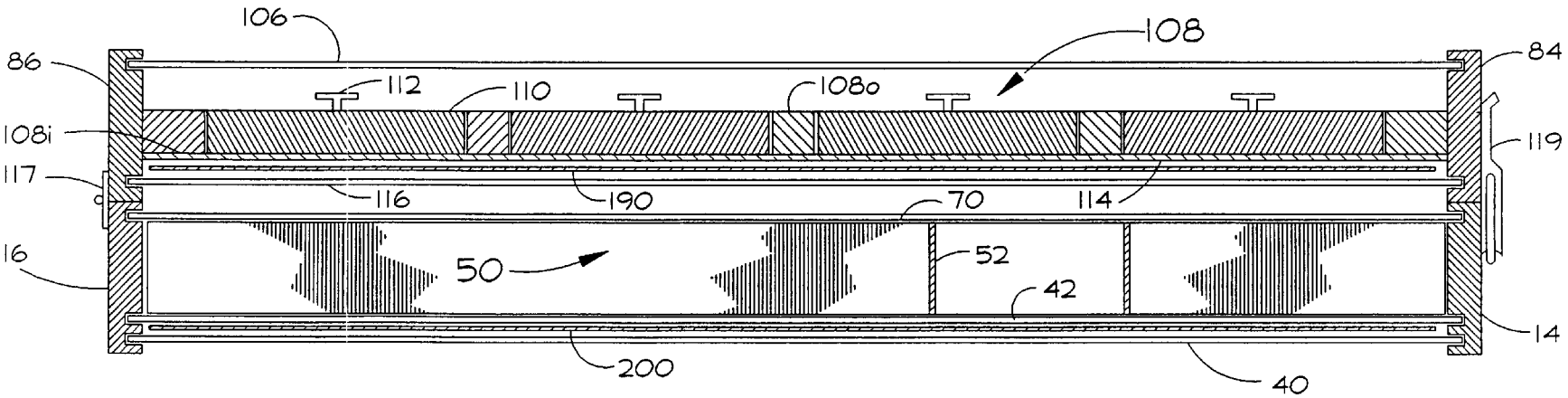
FIG. 13A is a cross-sectional view of the first and second section subassemblies of the invention in closed position taken substantially along line 13A—13A.
Figure 13B:
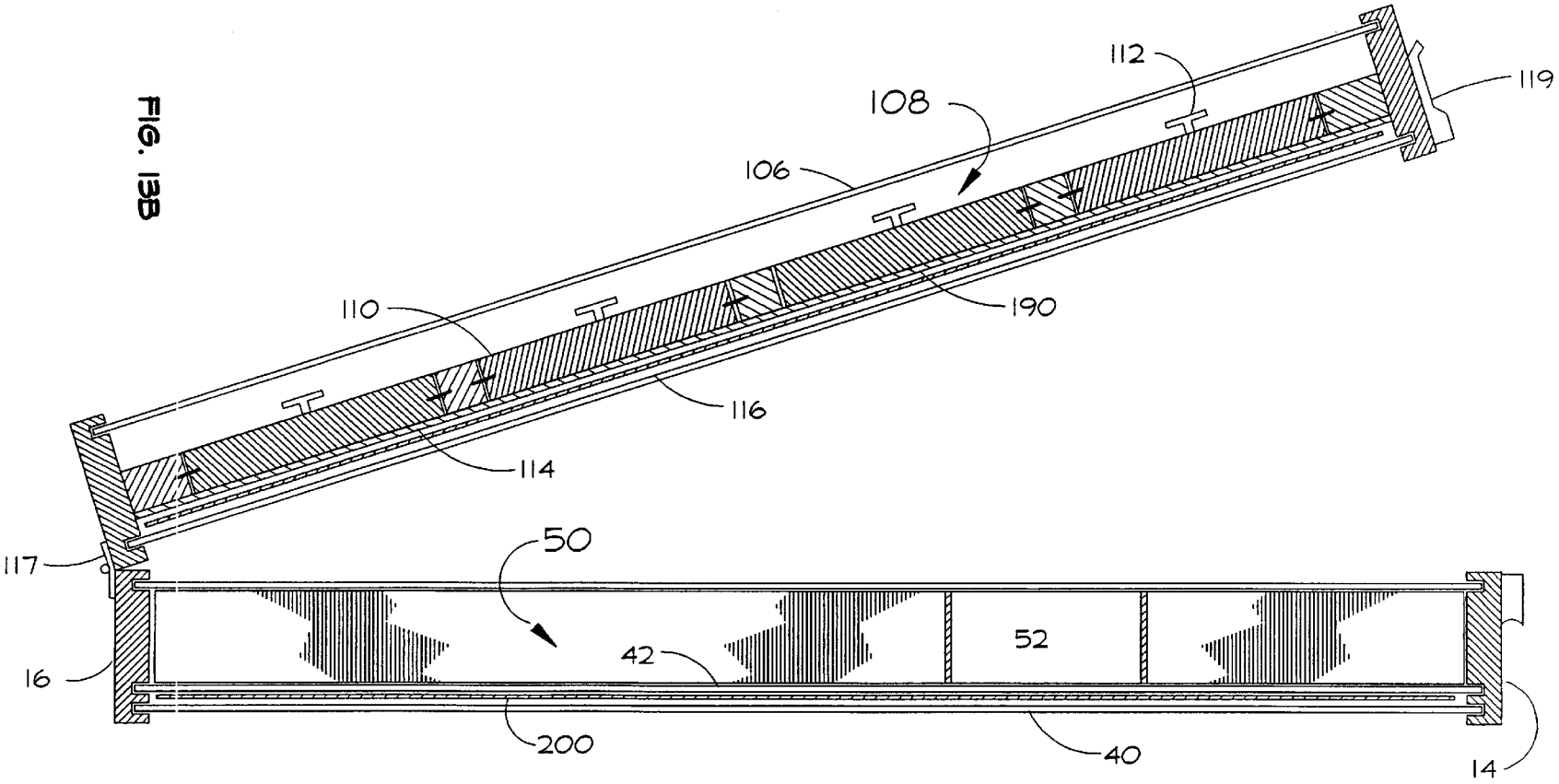
FIG. 13B is a cross-sectional view of the first and second section subassemblies of the invention in partially open position taken substantially along line 13B—13B.
Figure 14:
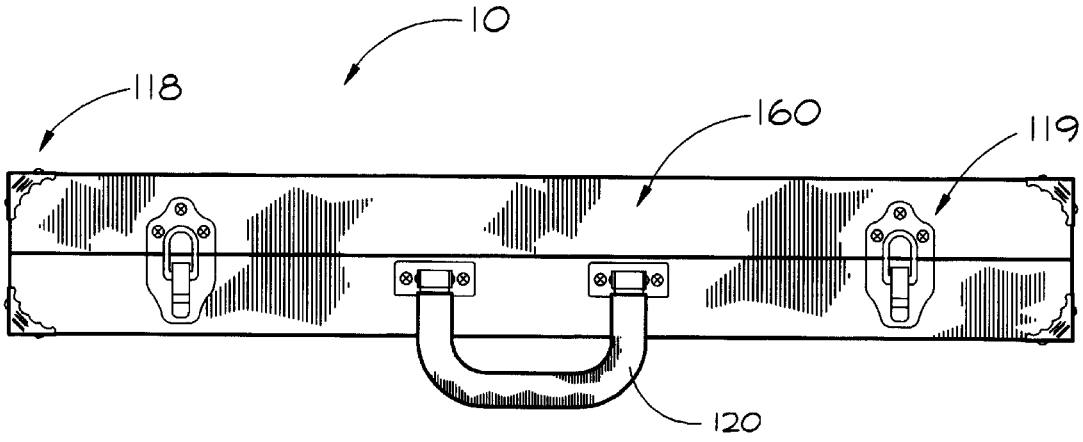
FIG. 14 is an outside front view of a preferred embodiment of the portable therapy case assembly of the present invention.
Figure 15:
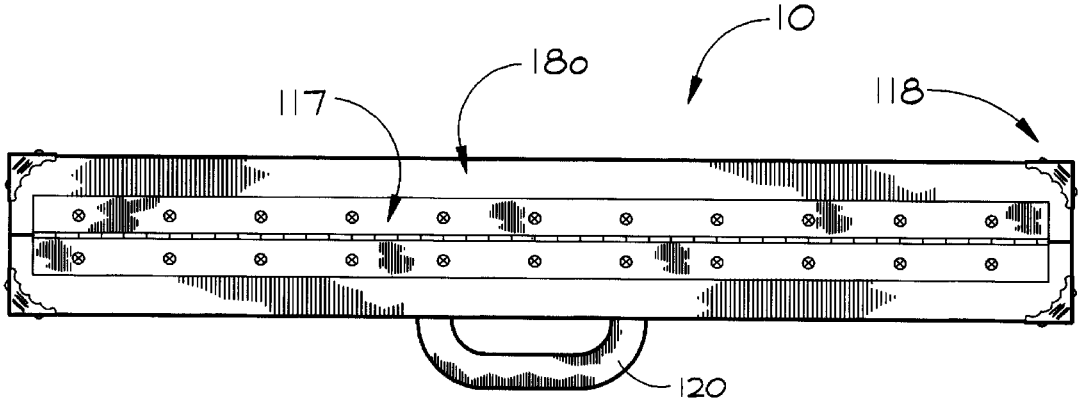
FIG. 15 is a back perspective view of the therapy case assembly of FIG. 14.

In a preferred embodiment, illustrated by example in FIGS. 4A through 7B, the first sliding means 30 is positioned proximal to and below each of the outboard widthwise surfaces; 16*ob*, 18*ob*, 20*ob* and 22*ob*; and comprises, or is formed by, each of the inside lengthwise surfaces, 16*i*, 18*i*, 20*i* and 22*i*, with each defining a guide slot or channel 30*a*, 30*b*, 30*c* and 30*d* within the first, second, third and fourth side members 16, 18, 20 and 22, respectively. Channels, 30*a*, 30*b* and 30*c* are formed or constructed within the inside lengthwise surfaces 16*i*, 18*i* and 20*i*, respectivley. Channel 30*d* is formed or constructed so as to connunicate or extend from the inside lengthwise surface 22*i* to the outside lengthwise surface 22*o* of the fourth side member 22 as illustrated in FIG. 6A. In this preferred embodiment, as illustrated, the channels 30*a,* 30*b,* 30*c* and 30*d* are positioned so as to generally be oriented along the same horizontal axis when the side members 16, 18, 20 and 22 are connected to one another. It will be understood that the guide slot or channels 30*a* and 30*b* can be any of a number of channeled members, track members or other structure facilitating sliding of a sliding sheet-type member; and that channels 30*c* and 30*d* can take any of a number of forms to facilitate this purpose.

In a preferred embodiment the fixed means 32 is positioned between the first sliding means 30 and the middle-portion space 26, and proximal and inboard of the first sliding means 30, adjacent to the outboard installation space 24 of the sidewall support 14, as illustrated in FIGS. 4A through 7B.

The fixed means 32 comprises, or is formed by, each of the inside lengthwise surfaces, 16*i,* 18*i,* 20*i* and 22*i.* The inside surfaces 16*i* and 18*i* each have constructed within them a side attachment slot, 32*a* and 32*b,* respectively; and the inside surfaces 20*i* and 22*i* each have an end attachment slot 32*c* and 32*d,* respectively. In this embodiment the side attachment slots, 32*a* and 32*b,* and the end attachment slots, 32*c* and 32*d,* are each positioned generally along the same horizontal axis when the side members 16, 18, 20 and 22 are connected to one another.

The first section subassembly 12 of the therapy assembly 10 is further provided with a first transparent sliding member 40, illustrated by example in FIGS. 1, 3, 16, 17, 19 and 30 and other firgures; which is installed (41) in and supported by the first sliding means 30. In a preferred embodiment the first transparent sliding member 40 is a rectangular-like, resilient, transparent sheet provided with first and second transparent surfaces 40' and 40", first and second side sections 40*a* and 40*b* and first and second end sections 40*c* and 40*d.* The first and second side sections, 40*a* and 40*b,* are slotted, channeled and slidably supported in the channels 30*a* and 30*b,* respectively; as illustrated in FIGS. 1, 3, 4A through 7B, 13 and 19. The first end section 40*c* is inserted through the channel 30*d* and, guided by channels 30*a* and 30*b,* comes to rest in channel 30*c.* When in this slided position the second end section 40*d* is supported within the channel 30*d,* in this embodiment.

Figure 16:
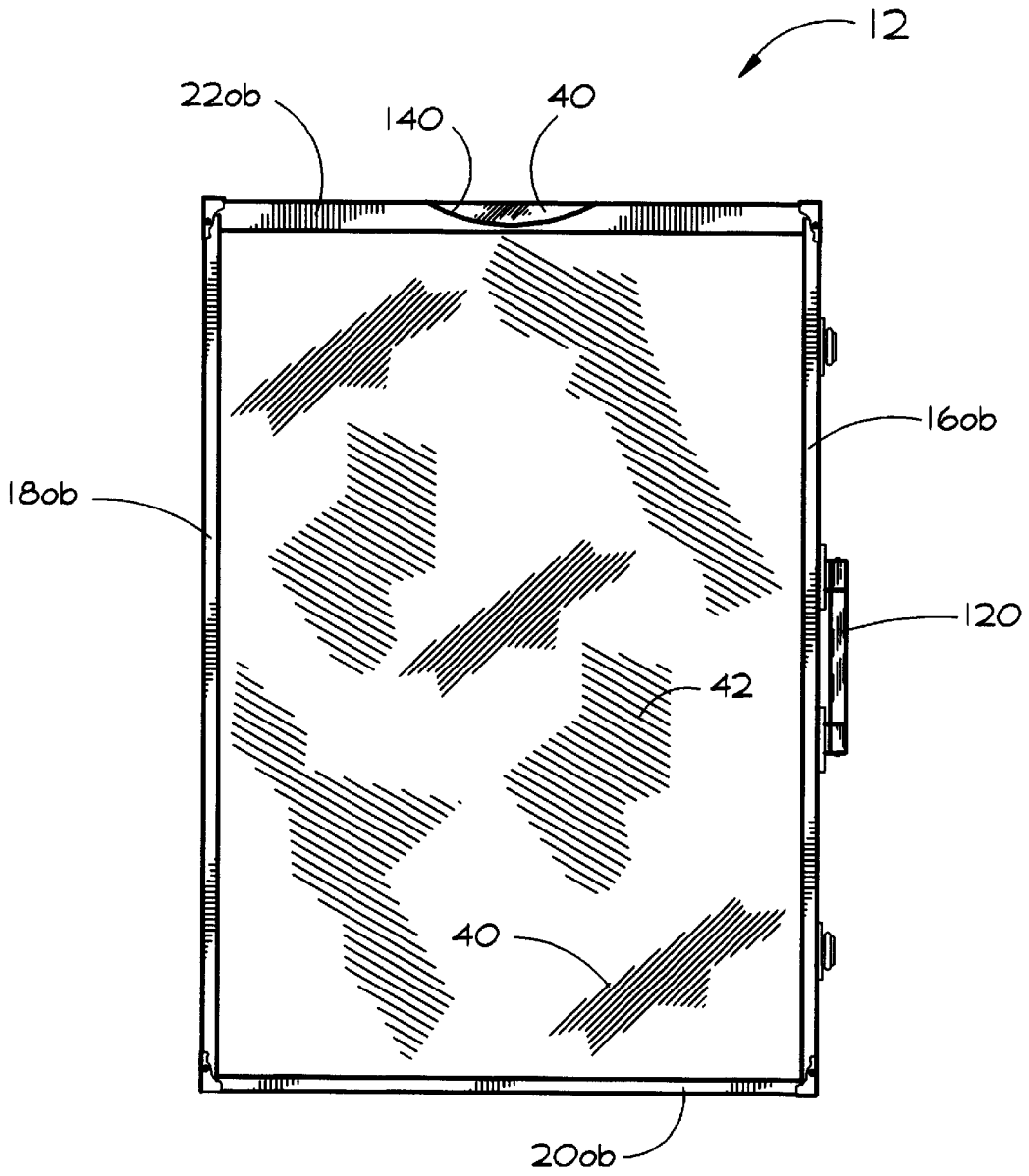
FIG. 16 is a top elevational view of the invention with the transparent sliding member (40) in installed position.
Figure 17:
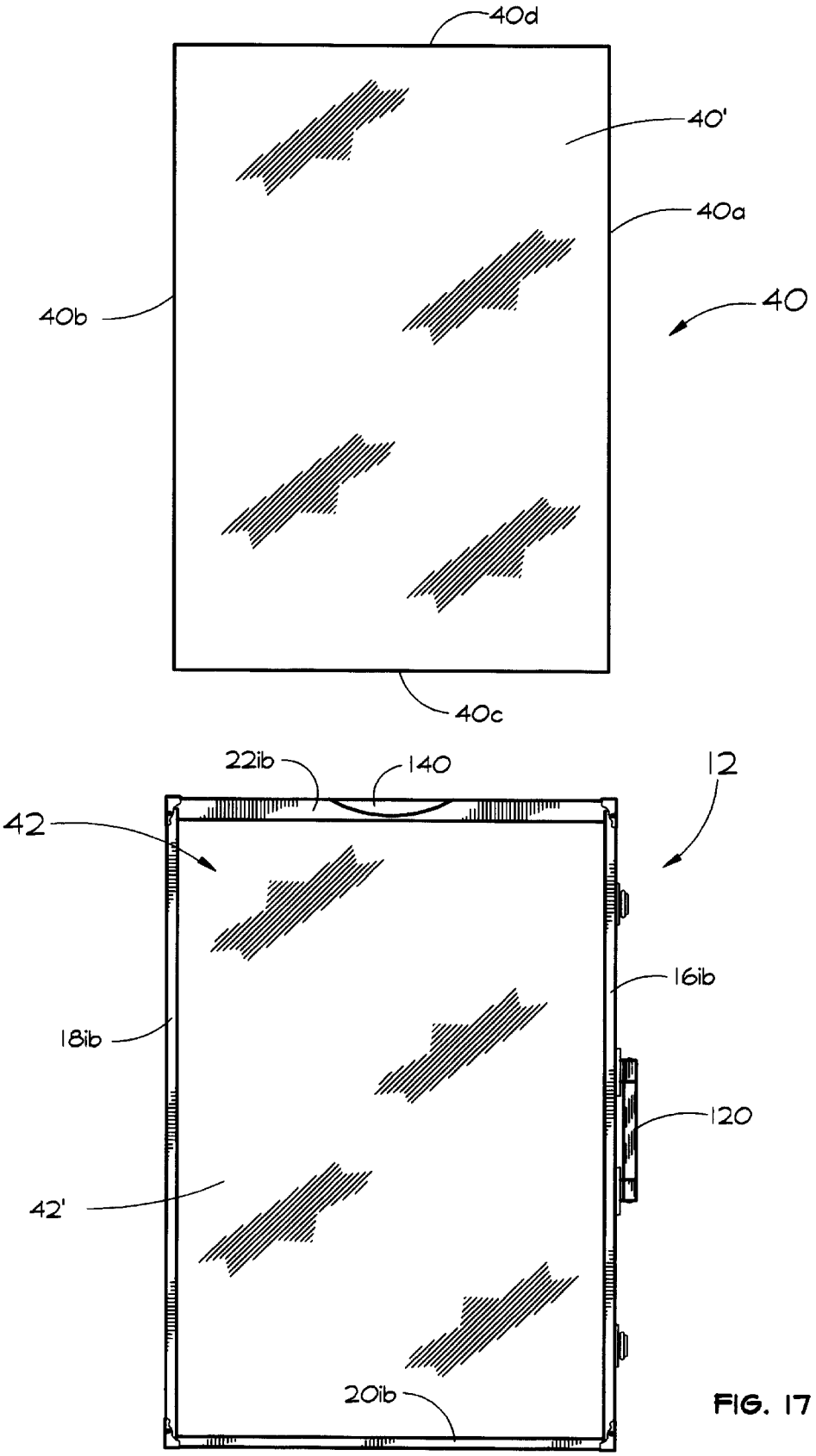
FIG. 17 is a further top elevational view of the invention of FIG. 16 illustrating the transparent sliding member (40) slided and extended along its sliding axis from the first section subassembly of the invention.
Figure 18:
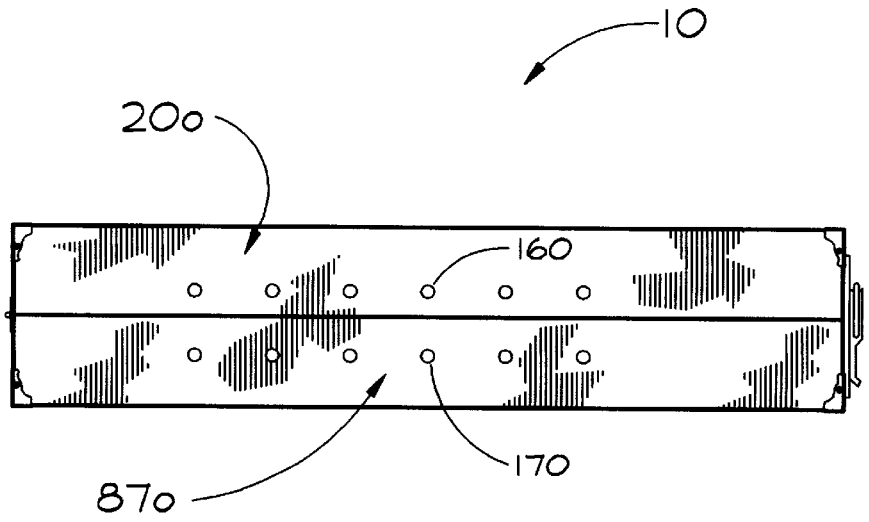
FIG. 18 is a left side elevational view of a preferred embodiment of the invention.
Figure 30:
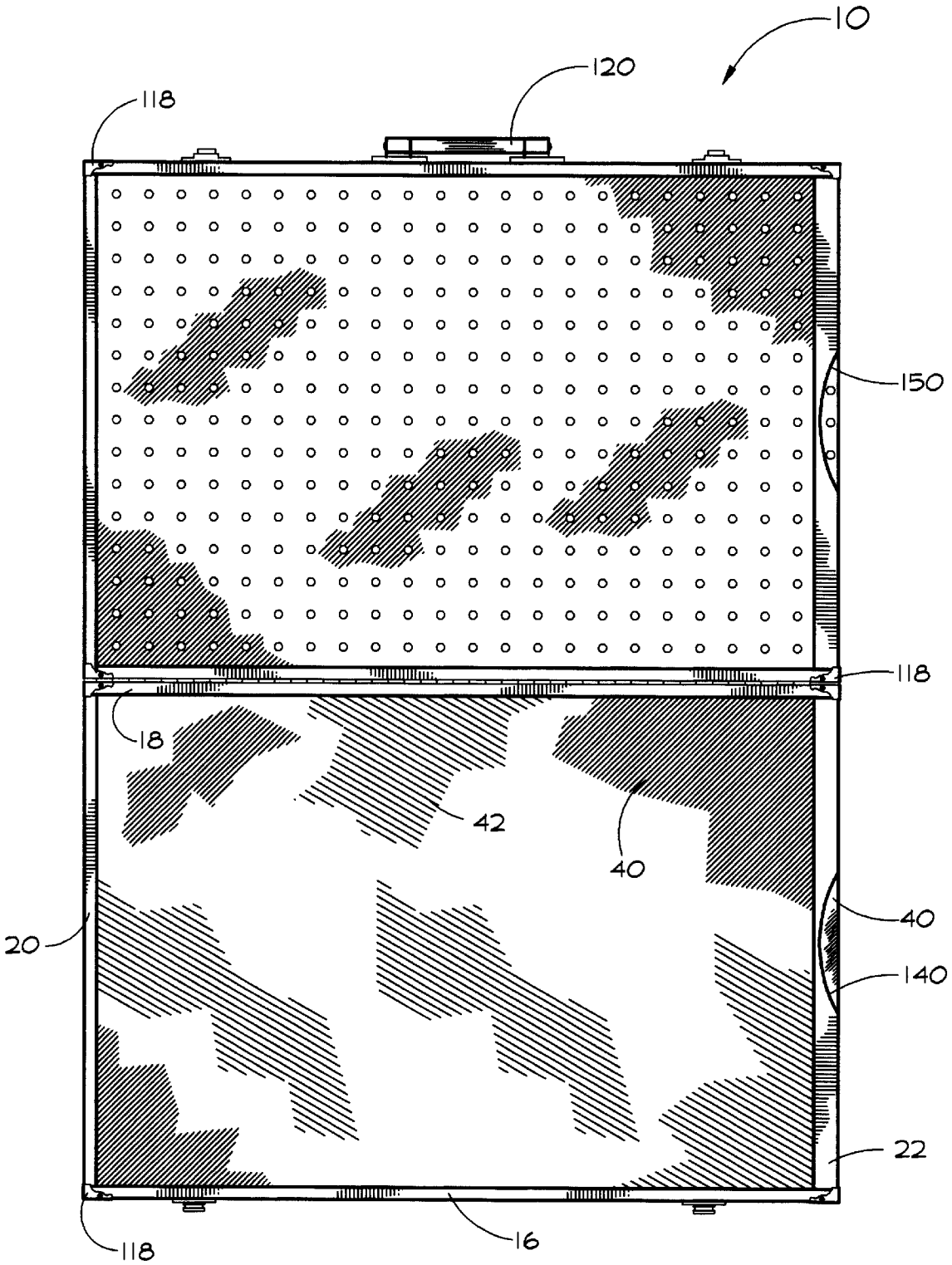
FIG. 30 is an outside front view of a preferred embodiment of the assembly of the present invention in an alternate partially opened condition.

The first section subassembly 12 is provided with an erasable board member 42 having first and second sheet-like surfaces, 42' and 42". The first surface 42' is preferably a wipe-away writing surface which permits various types of writing materials and implements to make a viewable impression or written or drawn character or design on the first surface 42', which, after use can be wiped and erased when so desired by the user to make other viewable impressions. It will be understood that many types of surfaces such as chalk, fiber-tipped writing/drawing boards, and many other types of surfaces can be utilized for this purpose. The board member 42 is preferably a rectangular-like configuration, but it will be recognized that many different configurations can be utilized. In a preferred embodiment utilizing a rectangular configuration, as illustrated in FIG. 3 and other drawings, each side of the board member is securely fixed and attached in each of the side attachment slots, 32*a* and 32*b,* and the end attachment slots 32*c* and 32*d;* respectively; of the sidewall support 14. When the board member 42 is in secured position as indicated and illustrated, the first surface 42' of the board 42 lies below and is viewable through the first transparent sliding member 40 when this member is slided into installed position as illustrated in FIGS. 16 and 30.

A dividing means construction 50 for providing storage space; illustrated by example in FIGS. 1, 2, 3, 13, 29, 31 and 32; is mounted on or adjacent to the second surface 42" of the erasable board member 42 within the sidewall support 14, within and adjacent to the middle-portion space 26, the inboard installation space 28 and adjacent portions of the inside lengthwise surfaces 16*i,* 18*i,* 20*i* and 22*i.* In a preferred embodiment the dividing means 50 is constructed from a number or plurality of dividing section members 52, although it will be recognized that an integral construction can also be provided for this construction. As illustrated in a preferred embodiment, the dividing section members 52 are positioned and attached both transversely (perpendiculary oriented) and parallel to one another. Each of the dividing section members 52, as illustrated, has an installation surface 54 and an exposed surface 56; and can be removably or detachably; coupled, secured or attached to the second surface 42" of the board member 42; and/or portions of the inside lengthwise surfaces 16*i,* 18*i,* 20*i* and/or 22*i;* within the middle-portion space 26 and inboard installation space 28; inboard of the board member 42 as positioned and secured in the sidewall support 14. Additionally, in a preferred embodiment, as illustrated in part in FIG. 31 the section members 52 can be interlocked with one another by section member grooves 58 provided as a part of the construction of the section members 52.

The sidewall support is further provided with a second sliding means 60 for receiving an additional sliding member later described herein. The second sliding means 60 is positioned within the inboard installation space 28 of support frame 14, generally proximal or adjacent and outboard of adjacent portions of the inboard widthwise surfaces 16*ib,* 18*ib,* 20*ib* and 22*ib;* as illustrated by example in FIGS. 3, 4A through 7B and 13. In a preferred embodiment the second sliding means 60 includes, or is constructed to contain, each of the inside lengthwise surfaces, 16*i* and 18*i,* each having proximal or adjacent to and outboard of the inboard widthwise surfaces 16*ob* and 18*ob,* and adjacent to or within the inboard installation space 28 of the sidewall support 14, a slidable slot 60*a* and 60*b,* respectively, positioned and oriented parallel and horizontally coaxial with one another, as illustrated by example. Additionally, in this embodiment the sliding means 60 further comprises an installation slot 60*d* channeled and extending through the fourth side member 22 from the inside lengthwise surface 22*i* to the outside lengthwise surface 22*o* which is positioned to be generally transverse (perpendicularly oriented) to and coaxial (oriented generally along the same horizontal axis) with the slidable slots 60*a* and 60*b.* Further, in this embodiment, the inside lengthwise surface 20*i* of the third side member 20 of sidewall support 14 is provided with an end slot 60*c.* It will be understood that though slotted means and construction are described and illustrated by example as the second sliding means 60 of the invention, and in other sliding means and construction constituting parts of the invention, that other constructed or provided members can be employed within the spirit and concepts of the invention including by example and not limited to, various track, flange, rack and pinion or roller-roller bearing apparatus, integrally or coupled sliding panel/sheet mechanisms, and other means of movably or slidably positioning a cover, panel, sheet or other member.

Figure 2:
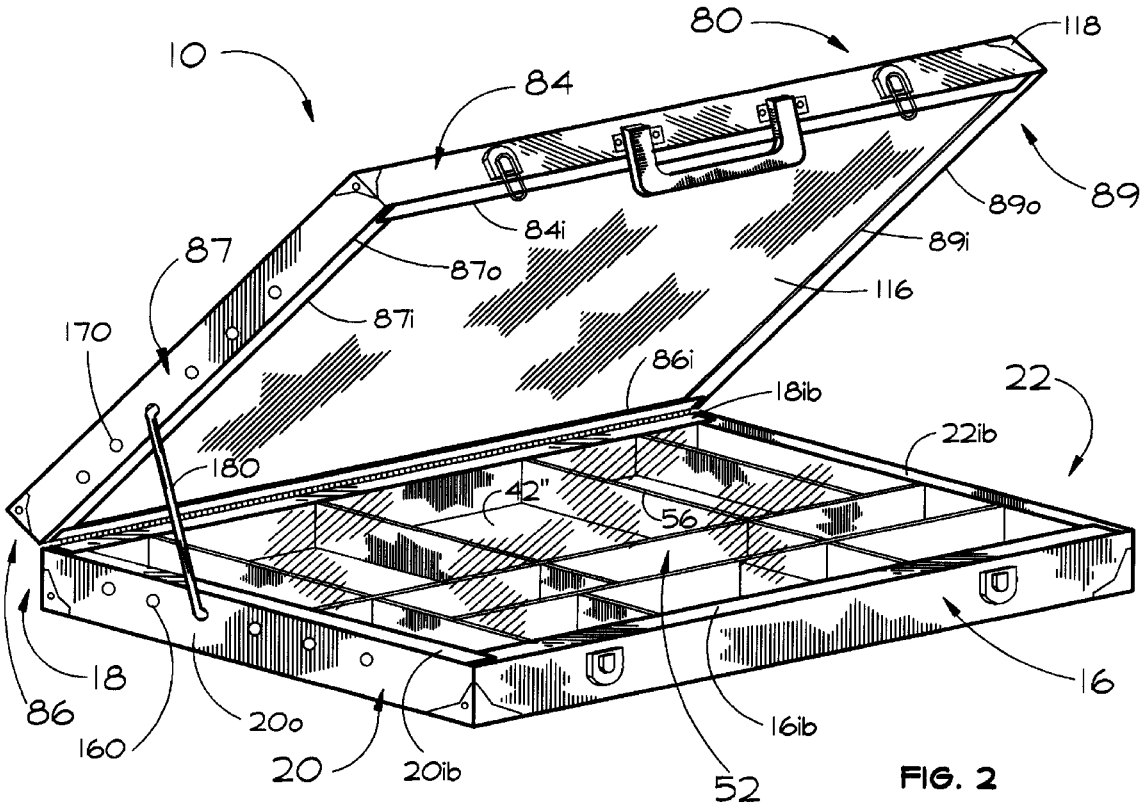
FIG. 2 is a perspective view taken from the other front side of FIG. 1.
Figure 29:
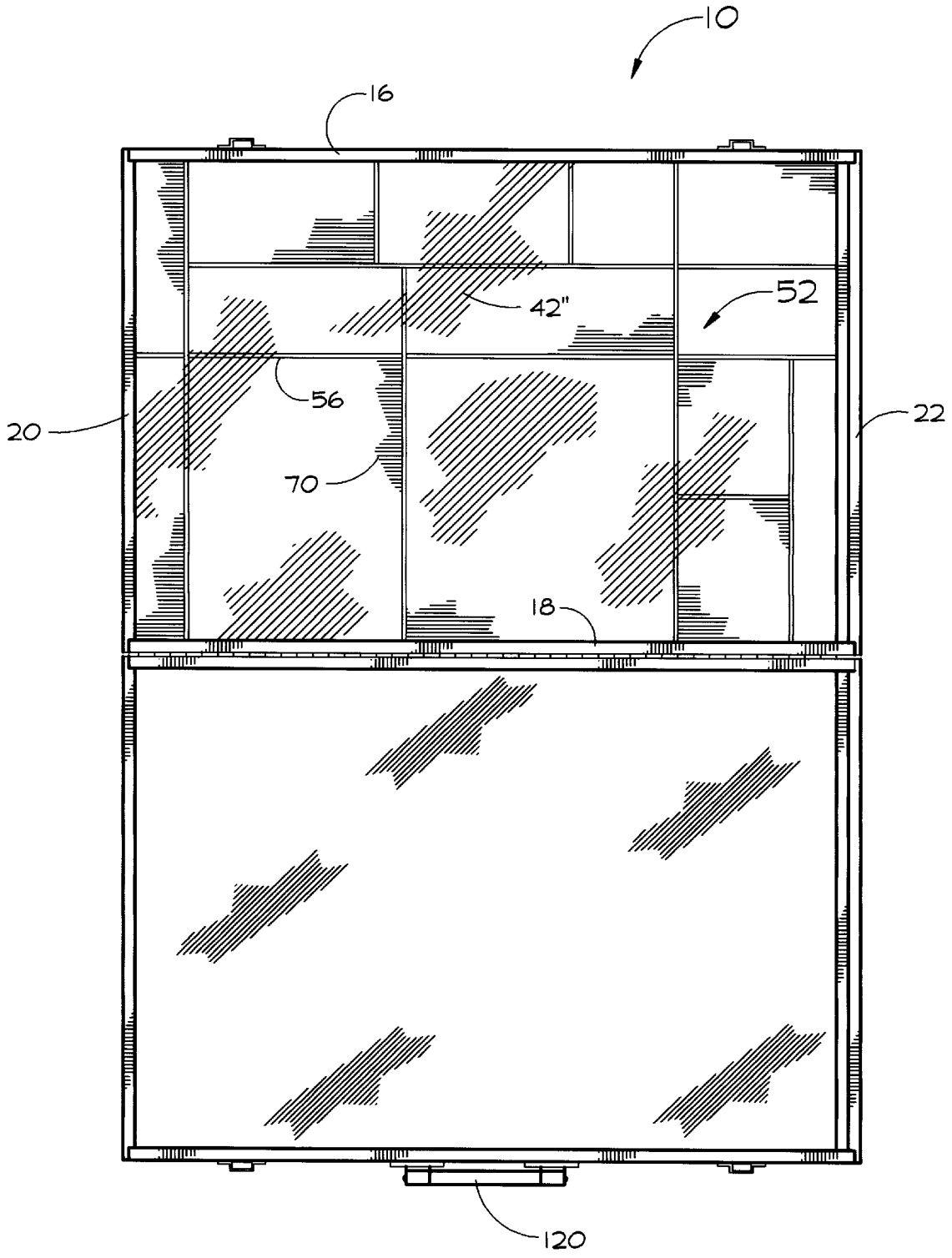
FIG. 29 is an inside front view of the assembly of the present invention in preferred embodiment in a partially opened condition.
Figure 32:
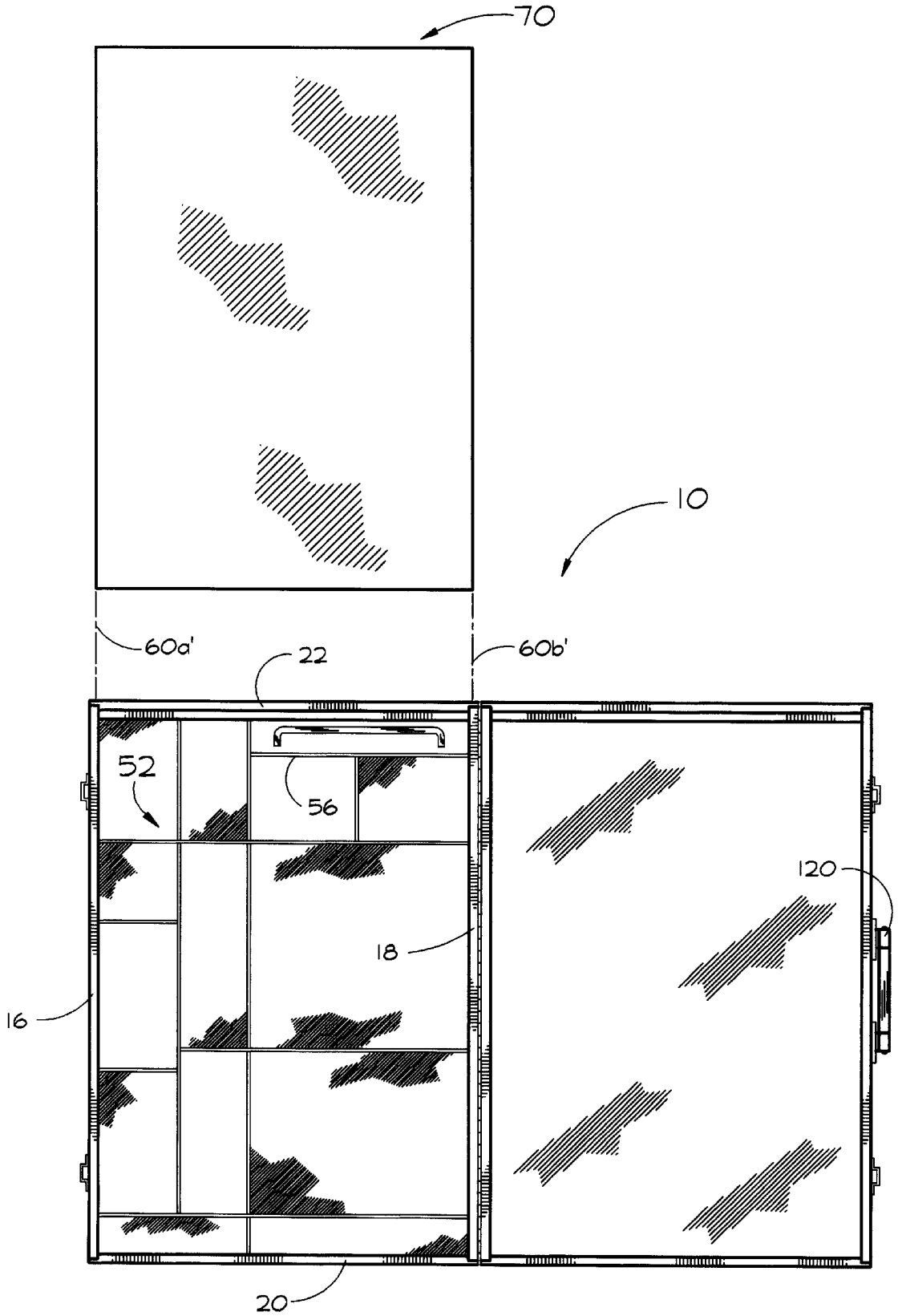
FIG. 32 is an inside front view of the assembly of the invention in an alternate open condition.
Figure 33:
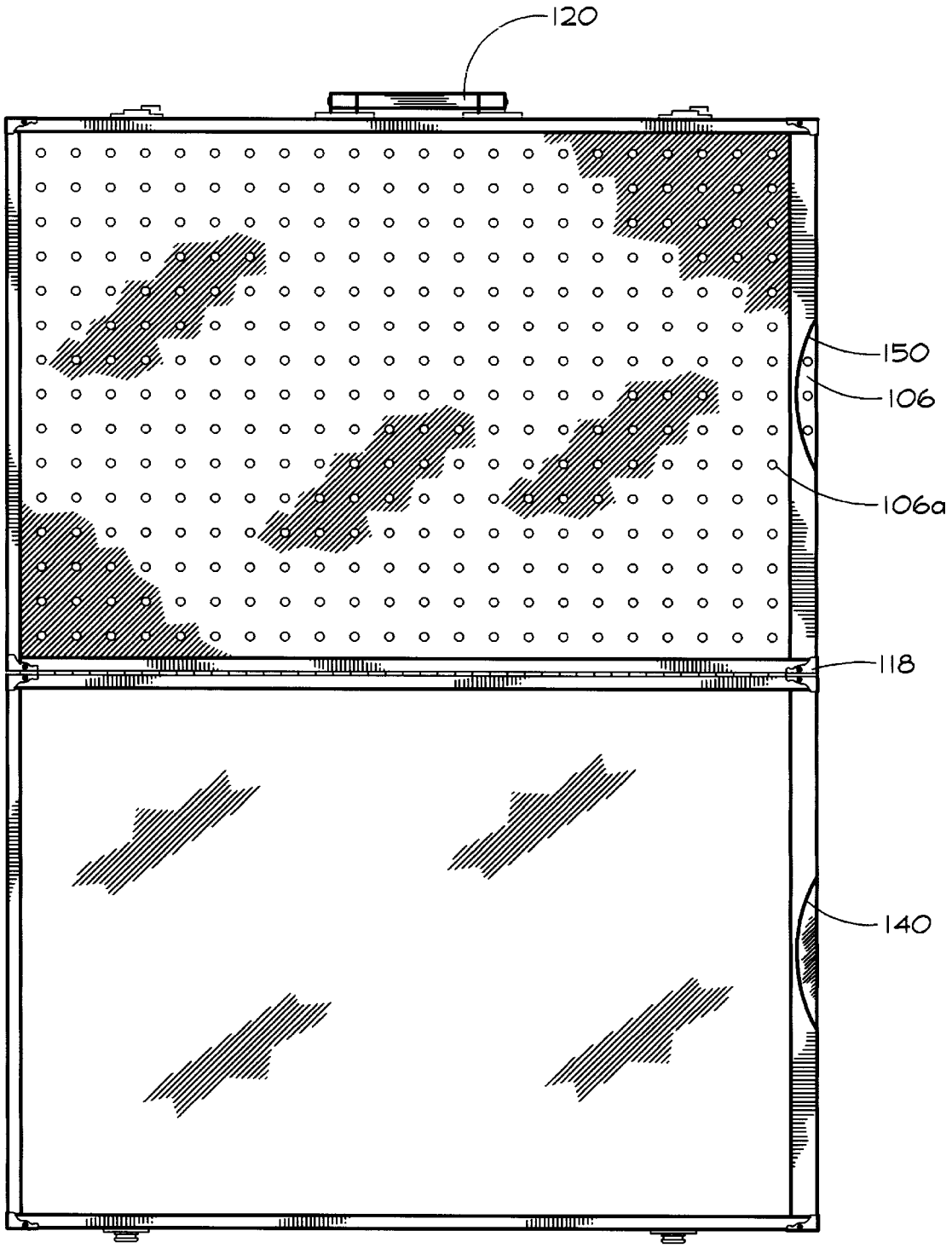
FIG. 33 is an outside front view of a preferred embodiment of the assembly in an alternate opened condition with the transparent sliding member (40) removed from the assembly.
Figure 34:
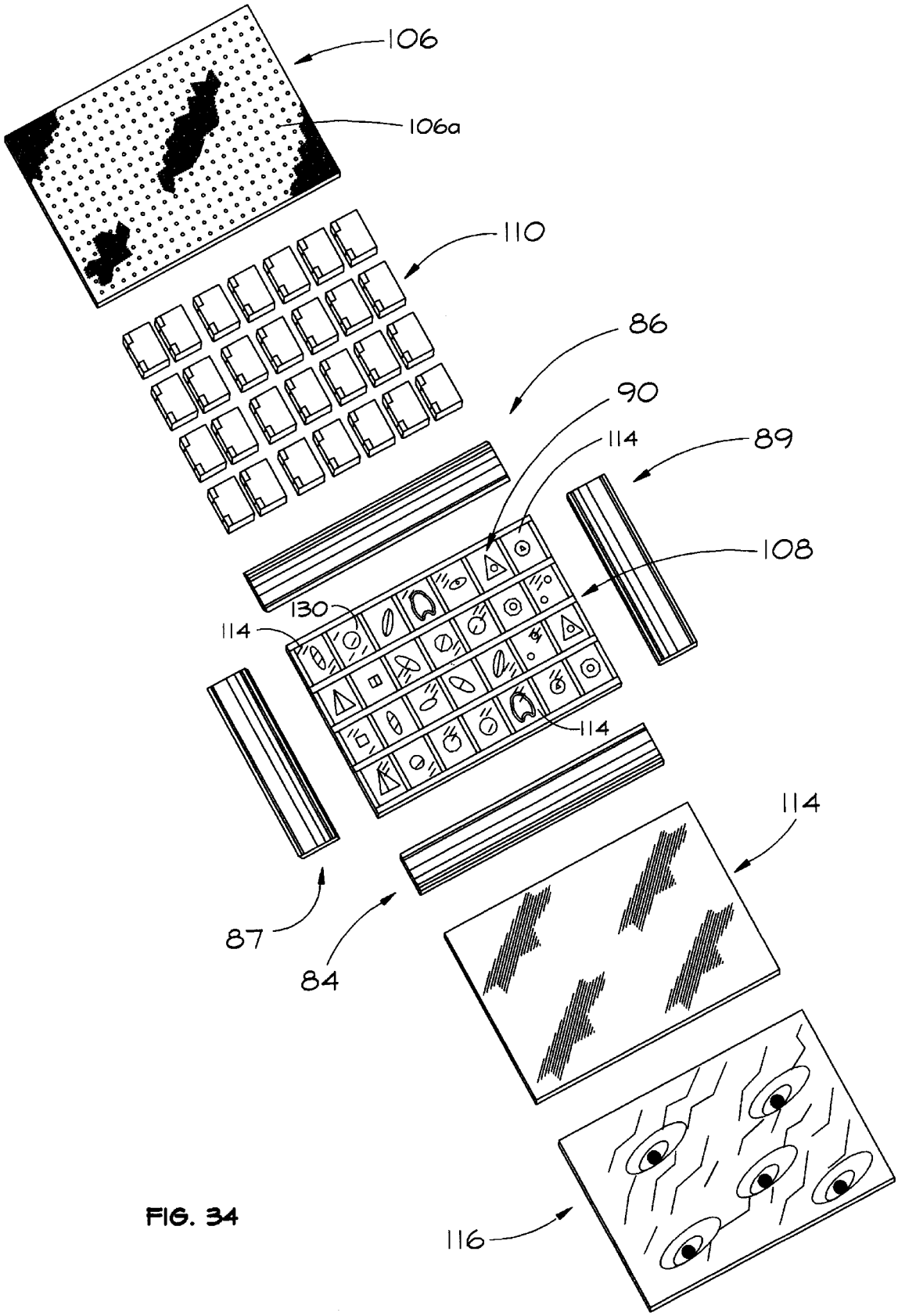
FIG. 34 is an exploded view of the second section subassembly of a preferred embodiment of the present invention with the sliding sheet member (190) in an installed position.
Figure 35:
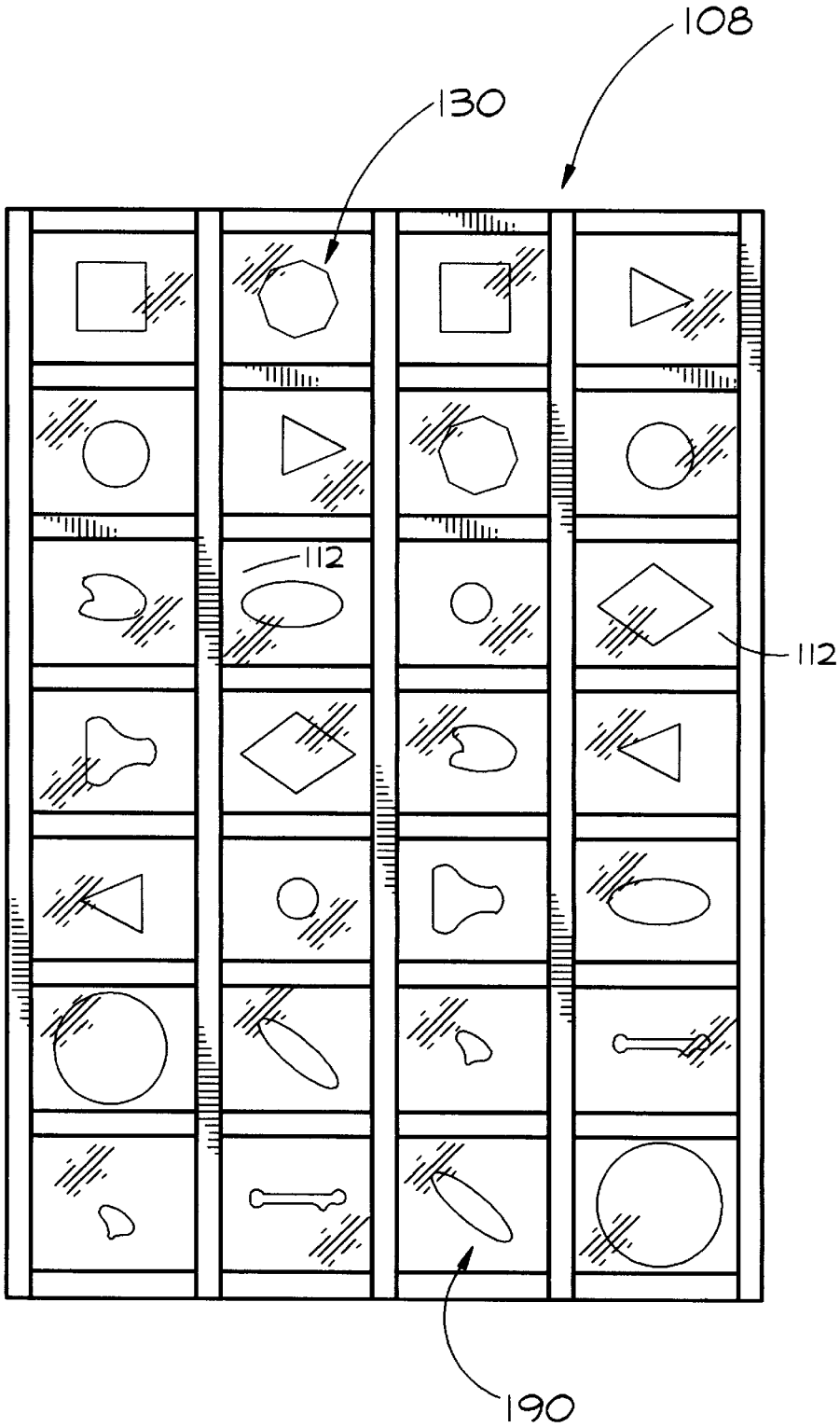
FIG. 35 is a front view of a preferred embodiment of the door frame shelf support (108) of the invention with the sliding sheet member (190) in an alternate installed condition.

Cooperating with and working within the second sliding means 60, as a sliding and cover member, is the second transparent sliding member 70; illustrated in FIG. 32 as sliding or positioning along the coextensive horizontal axis established by the axis 60*a*' of the slidable slot 60*a* and the axis 60*b*' of the slidable slot 60*b;* and other drawings. When the sliding member 70 is installed in full closed position to cover the dividing means construction, as illustrated in FIGS. 1, 2 and 29, the member 70 comes to rest at one of the end portions 70*c* at or within the end slot 60*c*. Additionally, the sliding member 70 is insertable, or installed, by registering and inserting one of the end portions 70*c* into the installation slot 60*d*, as generally illustrated in FIG. 32, and positioning the member 70 so that another end portion 70*d* comes to rest within the installation slot 60*d* when the end portion 70*c* is flush with or installed within the end slot 60*c* of the sidewall support 14.

The therapy assembly 10 is further provided with a second section subassembly 80 having a shelf matrix 82, as illustrated by example in FIGS. 1, 2, 8, 9A, 9B, 10A, 10B, 11A, 11B, 12A, 12B, 13, 20, 21, 22, 23, 24, 25, 26, 27, 28, 30, and 33, and FIGS. 34, 35, and 36.

The shelf matrix 82 is provided in a preferred embodiment as being generally rectangular in configuration, as illustrated; and has first side member 84, second side member 86, third side member 87, and fourth side member 89. The first and second side members, 84 and 86, are positioned and connected generally parallel to one another; as are the third and fourth side members, 87 and 89. Side members 84 and 86 are transverse positionally to side members 87 and 89. Each side member, 84, 86, 87 and 89, has respective inside and outside surfaces: 84*i*, 84*o*; 86*i*, 86*o*; 87*i*, 87*o*; and 89*i*, 89*o*; respectively. The matrix 82 has or defines within each of the inside surfaces, 84*i*, 86*i*, 87*i*, and 89*i*, a hollow outboard installation space 90, middle-portion space 92 and an inboard installation space 94; each of which is positioned spatially coextensive, vertically, with one another.

The shelf matrix 82 is provided with a sliding means 96 positioned proximal to the outboard installation space 90 for receiving a sliding member (to be described later herein); first means for securing a stationary member 98 positioned proximal to the middle-portion space 92; second means for securing a stationary member 100 positioned below or under the first means 98, between the middle-portion space 92 and the inboard installation space 94; slotable means 102 positioned inboard of the second means 100 for receiving a sliding member or symbolized sheet member (to be described later herein); and third means for securing a stationary member 104 which is positioned adjacent between the slotable means 102 and the inboard installation space 94 or positioned adjacently inboard of the slotable means 96 and generally within the inboard installation space 94.

The second section subassembly 80 has a sliding support surface 106 which is provided with a number or plurality of installation holes 106*a*. The support surface 106 is preferably slided and positionally registered, engaged, installed, or mounted and supported on or within the sliding means 96 of the shelf matrix 82, so that the support surface 106 can be utilized for optional slidable attachment in the sliding means 96 and for use in a therapy or game context, by mounting various items in the installation holes 106*a*.

The second section subassembly 80 is also provided with a door frame shelf support member 108, provided with an outboard surface 108*o* and an inboard surface 108*i* and having a number of positionable door members 110; as illustrated in FIGS. 21 through 28 and FIGS. 8, 34 and 35. The door members are preferably mounted between the outboard and inboard surfaces, 108*o* and 108*i*. The door frame shelf support 108 is fixed and secured in stationary position on or within the first means for securing a stationary member 98. Additionally, in a preferred embodiment, the door members 110 are provided with symbolized identification handle members 112 for use or utilization of a user's skills in recognition and/or in relation to other parts of the therapy assembly 10.

A stationary transparent member 114 is securely fixed and attached, or otherwise securely installed, on or within the second means for securing a stationary member 100 of the shelf matrix 82 so that it is positioned adjacent to the inboard surface of the door frame shelf support member 108*i*. The stationary transparent member 114 is preferably a thin and resilient sheet like member which is secured under the opening, positionable door members 110 to protect sliding symbolized sheet members, to be described later herein, to be inserted under the door members 110.

The subassembly 80 is also provided with an inboard wall panel 116 which is fixedly secured and attached in stationary position on or within the third means for securing a stationary member 100 within the shelf matrix 82 and is preferably a resilient and resistent inboard wall section panel. It will be recognized by those skilled in the art that, as is the case for many of the members and components of the subassemblies 10 and 80, that a number of diverse materials with varying ranges of transparency and opaqueness can be utilized as the constructive material for the inboard wall panel 116.

The therapy assembly 10 is further preferably provided with means for coupling the first section subassembly 12 and the second section subassembly 80 so that they will have positionable and securable interface and positional relationship to one another. Preferably, this is provided by hingable means 117 or hinge-like members securing and coupling the sidewall support 14 and the shelf matrix 82; and clasp means 119 for releasable securement thereof.

In a preferred embodiment the therapy assembly 10 is further provided with support bracket means 118 positioned in various locations, as illustrated by example in FIGS. 1, 2, 14, 15, 16 through 20, 21, 22, 23, 30, and 33, adjacent to the outside surfaces of the first, second, third and fourth side members 16*o*, 18*o*, 20*o* and 22*o* of the sidewall support 14, and adjacent and connected to the outside surfaces of the first, second, third and fourth side members, 84*o*, 86*o*, 87*o* and 89*o* of the shelf matrix 82; for reinforcing and structural support of these members. Preferably, this support bracket means 118 is provided by a plurality or number of corner support components or other advantageously positioned and located support components. It will be recognized that many diverse types of support means can be so provided as illustrated and otherwise.

Additionally, in preferred embodiments, the therapy assembly 10 is provided with means, mounted adjacent to the outside surface of the first side member 16 of the sidewall support 14 or the first side member 84 of the shelf matrix 82, for portably transporting 120 the therapy assembly 10. Preferably, as illustrated, this is a handle member or other gripable member for carrying and transporting the assembly 10, and it will be recognized that many types of components can be employed for this purpose.

The sliding means 96 of the shelf matrix 82 is preferably provided as an internal or inside part of the shelf matrix 82, and more particularly as a part of the inside surfaces of the respective first, second, third and fourth side members, 84*i*, 86*i*, 87*i* and 89*i*, respectively. In this preferred embodiment the inside surfaces 84*i*, 86*i* and 87*i* are provided with (or define) a guide slot, 96*a*, 96*b* and 96*c*, respectively. The guide slots 96*a* and 96*b* of the first and second side members 84 and 86, respectively, are positioned generally parallel and coaxial (i.e., along the same horizontal axis) with one another. The guide slot 96*c* of the third side member 87 is positioned transversely and coaxial to the guide slots 96*a* and 96*b*. The inside surface 89*i* has or defines an insertion slot 96*d* which preferably extends through the fourth side member 89, from the inside surface 89*i* thereof to the outside surface 89*o*. This insertion slot 96*d* is generally parallel to the guide slot 96*c* of the third side member 87, transverse in position to the guide slots 96*a* and 96*b*, and coaxial (generally along the same axis) with the guide slots 96*a*, 96*b* and 96*c*. The insertion slot 96*d* serves as the initial engagement and/or register point for the slotable and slidable interface of the sliding support surface 106, as illustrated generally by example in FIGS. 13, 21, 8 and 33. In one preferred embodiment as illustrated the support surface is a sliding peg board sheet component. It will be recognized as indicated earlier that the support surface 106 can be other types of slidable sheet members having a diversity of support surface holes 106*a*.

The first means for securing a stationary member 98 of the shelf matrix 82 is also, preferably, made a part of the internal structure of the matrix 82; and in a preferred embodiment is provided where each of the inside surfaces, 84*i*, 86*i*, 87*i* and 89*i*, proximal to the middle-portion space 92, inboard of the sliding means 96 (as earlier discussed and indicated), is provided with an attachment slot, 98*a*, 98*b*, 98*c* and 98*d*, respectively. Each of the slots is generally coaxial with each other. Attachment slots 98*a* and 98*b* of the first and second side members 84 and 86, respectively, are generally parallel to one another, and the attachment slots 98*c* and 98*d* are generally parallel with one another and generally transverse in position to the slots 98*a* and 98*b*. It will be recognized, as indicated earlier, that various track and channel components may be utilized as a part of the first means 98.

Additionally, the door frame shelf 108 can be secured inside the shelf matrix 82 in a number of other ways with or without the use of slots or channeling to secure portions of the shelf 108 between the outboard and inboard surfaces 108*o* and 108*i*, or to otherwise secure the shelf 108 in the general position described for placement of the first means for securing a stationary member 98.

The second means for securing a stationary member 100 of the shelf matrix 82 in preferred embodiment comprises portions or sections positioned on or along the inboard surface 108*i* of the door frame shelf support member 108 for securing and attaching thereto the stationary transparent member 114. It will be recognized that many means can be utilized to attach the transparent member 114 inboard of the door frame shelf 108. And when attached to the door shelf 108 by such means will be positioned so that the transparent member 114 will be positioned under the inboard surface 108*i* for see-through viewing to any sheet or symbolized or descriptive sheet slid below or inboard of the transparent member 114, as illustrated and described further herein.

The slotable means 102 of the shelf matrix 82 is formed and constructed in a preferred embodiment by each of the inside surfaces, at or adjacent to the earlier described and illustrated positional location of the slotable means 102, 84*i*, 86*i*, 87*i* and 89*i*, of the first, second and third side members 84, 86 and 87 of the shelf matrix 82; having or defining a sheet guide flange portion 102*a*, 102*b* and 102*c*, respectively; each of which is generally positioned along or on the same horizontal axis, as illustrated. The sheet guide flange portions 102*a* and 102*b* of the first and second side members 84 and 86, respectively, are positioned generally parallel with one another along the same axis as indicated. The sheet guide flange portion 102*c* of the third side member 87 is positioned generally transverse along the same axis to the sheet guide flange portions of the first and second side members 102*a* and 102*b*.

The fourth side member 89 of the shelf matrix 82 is provided along the referenced inside surface 89*i* with a sheet insertion channel 102*d* which extends from the inside surface 89*i* to the outside surface 89*o* of the fourth side member 89, and is generally parallel with the sheet guide flange portion 102*c*, transversely positioned generally to the sheet guide flange portions 102*a* and 102*b*, and coaxial with the portions 102*a*, 102*b* and 102*c*. The sheet insertion channel 102*d* serves for slidable insertion, register and guidance of a symbolized sheet 130.

As illustrated by example in FIGS. 9A through 12B, 13, 34 and 35, the symbolized sheet 130 is slidably installed and positioned within the slotable means 102, and the sheet guide flange portions 102*a*, 102*b* and 102*c*, and the sheet insertion channel 102*d*. In preferred embodiment the symbolized sheet is provided having symbolized or descriptive areas or portions which will align or register with the door openings 108*a* which are defined or provided by the door frame shelf support 108, when the Sheet 130 is in installed position, as illustrated; and when the positionable door members 110 are in pivoting open position.

Figure 23:
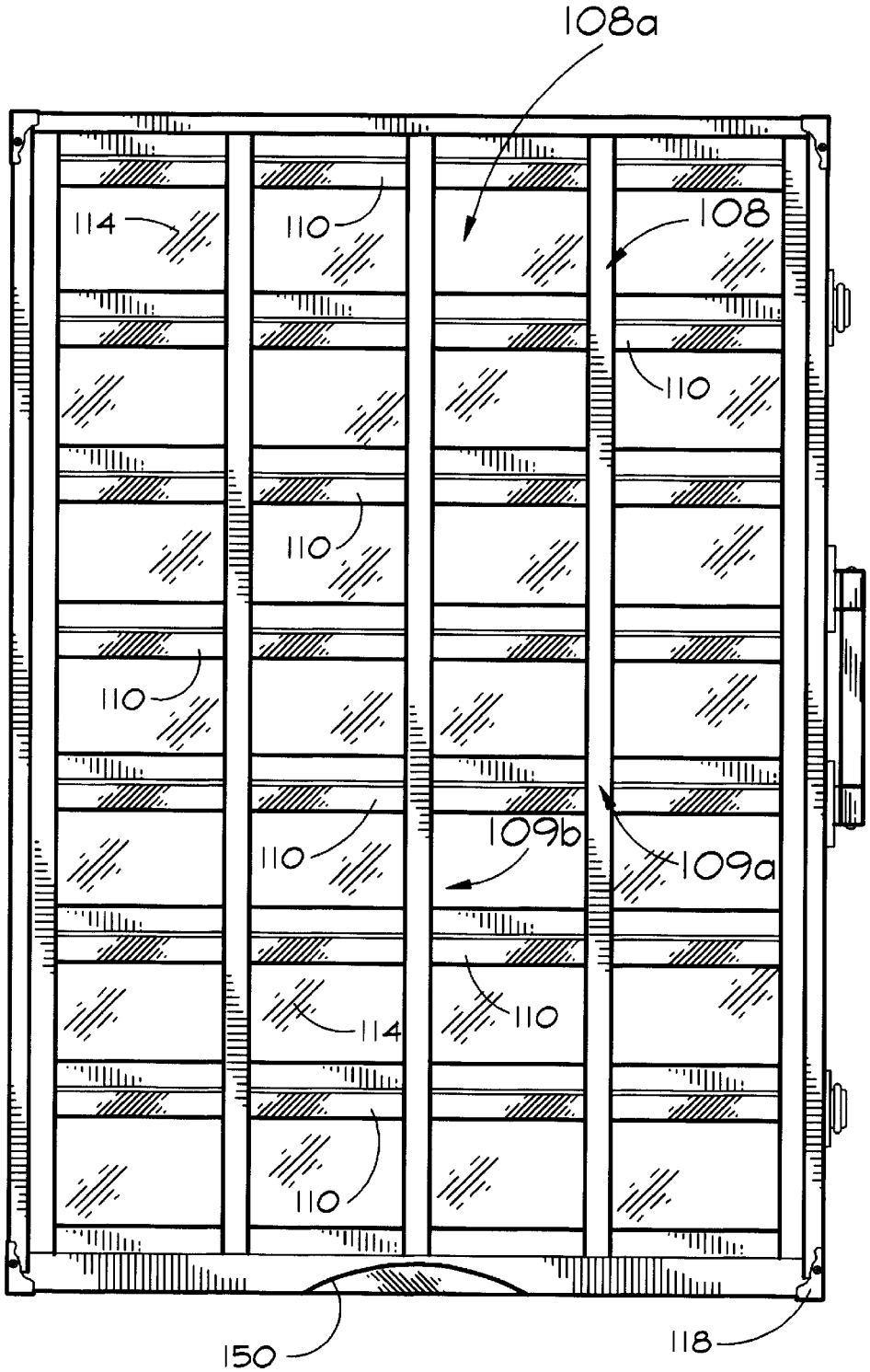
FIG. 23 is a top elevational of the second section subassembly of the invention in an alternate partially opened position where the positionable door members (110) are in an opened position.
Figure 24:
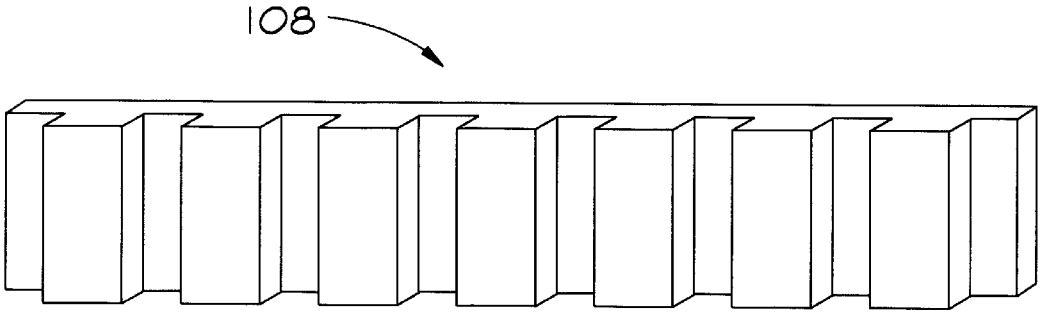
FIG. 24 is a perspective view of a section of the door frame shelf support member (108) of the second section subassembly of one preferred embodiment of the invention.
Figure 25:
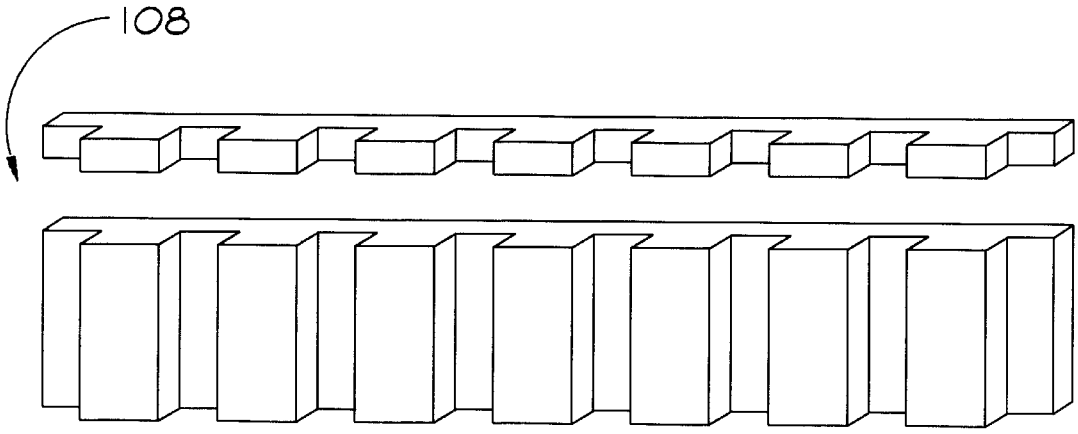
FIG. 25 is a perspective view of another section of the second section subassembly of a preferred embodiment of the invention of FIG. 24.
Figure 26:
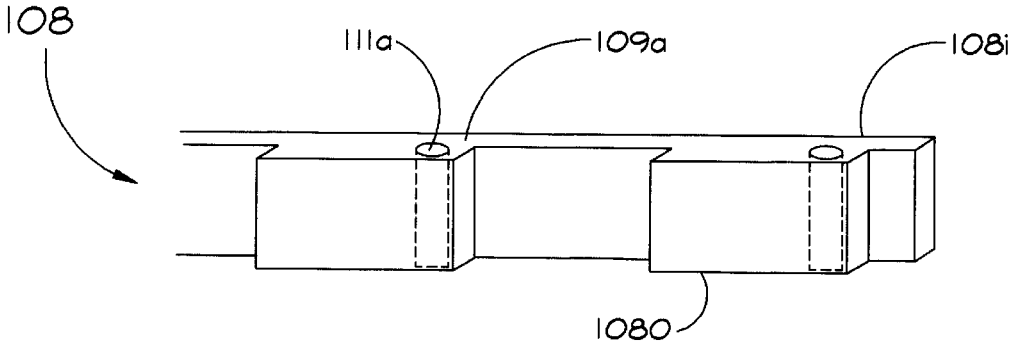
FIG. 26 is a perspective view of another section of the door frame shelf support (108).
Figure 27:
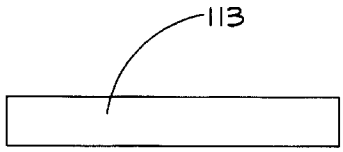
FIG. 27 is a front view of a door member (110) and dowel (113) of a preferred embodiment of the door frame shelf support (108) of the present invention.
Figure 28:
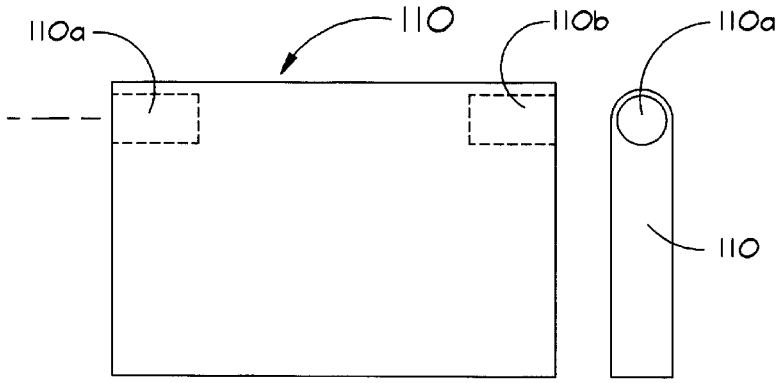
FIG. 28 is a top view of the door (110) of FIG. 28.
Figure 31:
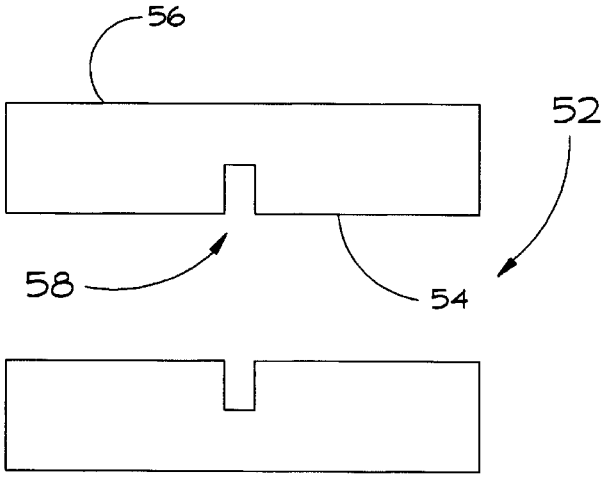
FIG. 31 is a front side view of two section members (52) of a preferred embodiment of the dividing section (52) of the first section subassembly of the present invention.

In preferred embodiment the door openings 108*a* are frame units, each having at least one dowel support portion 109*a* and preferably two such portions juxtaposed, adjacent or opposite to one another along a common axis; as illustrated generally by example in FIGS. 23 and 26. Additionally, the door opening 108*a* is provided with at least one doorjamb or doorpost member or portion 109*b*. The dowel support portion 109*a*, and each such portion, has or defines a dowel hinge installation channel 111*a*; and each positionable door member 110 has or defines at least one or two dowel support channels 110*a* and 110*b*, respectively. The door frame shelf support 108 is further provided with a number or plurality of dowel members 113, each of which is received for installation within the door openings 108*a*, as illustrated in FIGS. 26, 27 and 28. As illustrated, the each dowel member 113 is received within and installed in the dowel hinge installation channel 111*a* of a dowel support member 109*a* and the corresponding or adjacent, respective, dowel support channel 110*a* of the positionable door member 110 to be pivotably mounted in each door opening 108*a*.

Additionally, it will be understood that the door frame shelf support member 108 with positionable door members 110 can be constructed and put together structurally in many different ways. One such way illustrated by example comprises cutting a portion of constructive material to be utilized into lengths of board or material, cut into widths for doors, side rails, door frames, etc.; a process where widths for the door frames are slotted half the thickness of the board or material, and placing the slots at the proper distance to form the door frame; cutting the widths into strips the proper thickness for the vertical and horizontal door frame strips; and drilling or otherwise making holes in the strips for the pins that make the door hinge and fixedly attaching and securing the strips together with the doors and pins that hold the doors in pivotable position. These various constructive process procedures are illustrated by example in FIGS. 23, 24, 25, 26, 27, 28 and 35.

The third means for securing a stationary member 104 of the shelf matrix 82 in a preferred embodiment more particularly comprises each of the inside surfaces 84*i*, 86*i*, 87*i* and 89*i* at relevant positions earlier described for the position of the third means 104 within the first, second, third and fourth side members 84, 86, 87 and 89; having an inboard wall attachment channel 104*a*, 104*b*, 104*c* and 104*d*, respectively. The inboard wall attachment channels 104*a*, 104*b*, 104*c* and 104*d* forming in this preferred embodiment the third means for securing a stationary member 104; are positionally aligned in reference to one another so that channels 104*a* and 104*b* are generally parallel to one another; channels 104*c* and 104*d* are generally parallel to one another; channels 104*a* and 104*b* are generally transverse positionally to channels 104*c* and 104*d;* and each of the channels is provided along the same general horizontal axis for planed or relatively flat attachemnt of the inboard wall panel 116. It will be understood that as positioned, as illustrated, the wall panel 116 can be attached to the shelf matrix 82 by many diverse means and ways.

Figure 19:
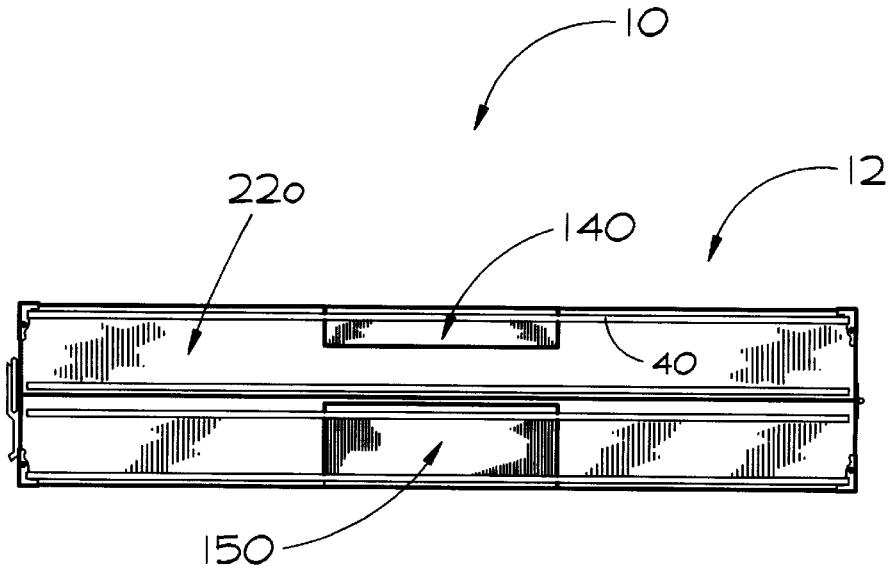
FIG. 19 is a right side elevational view of the invention.
Figure 20:
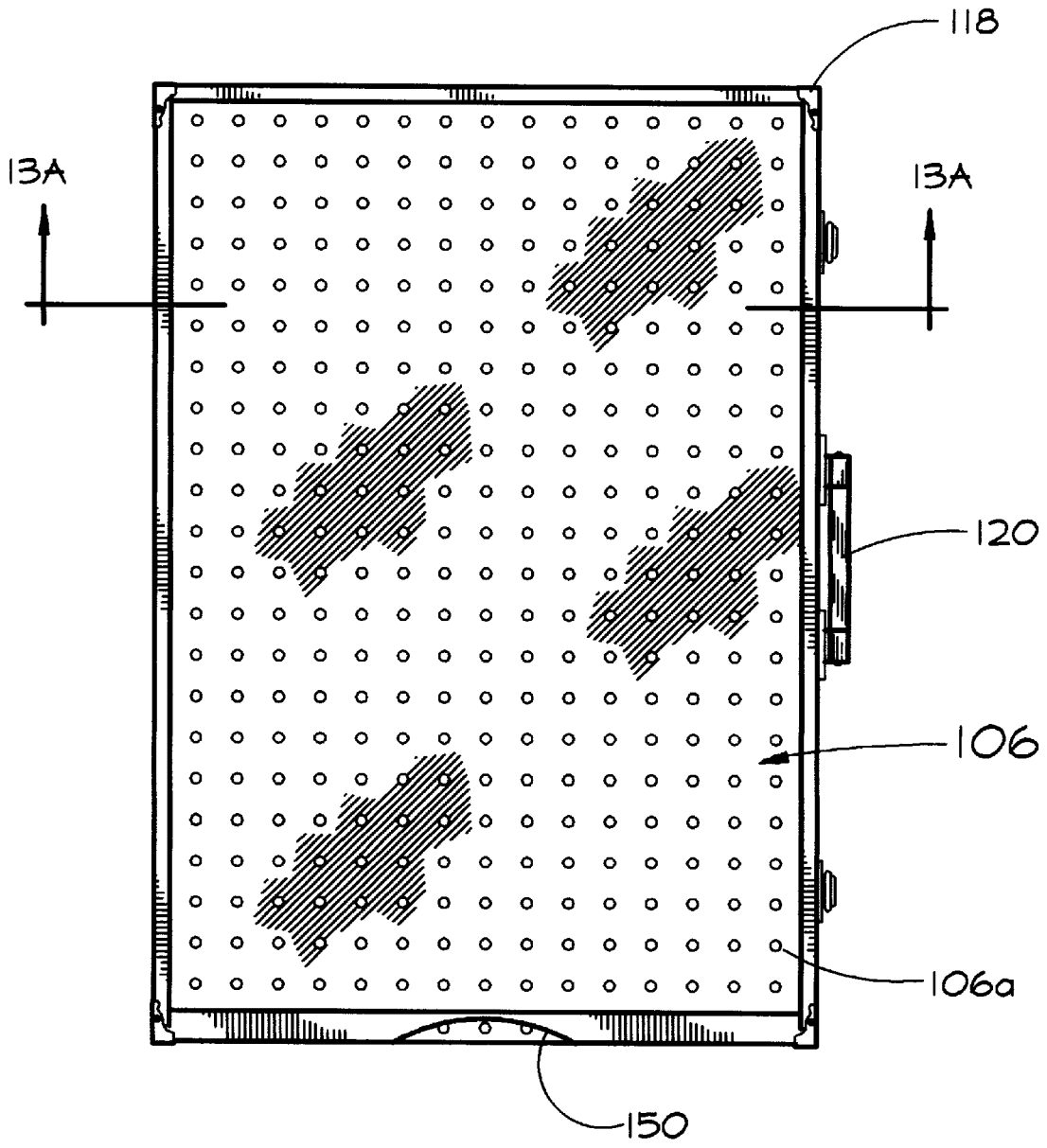
FIG. 20 is a top elevational view of the second section subassembly of a preferred embodiment of the invention.
Figure 21:
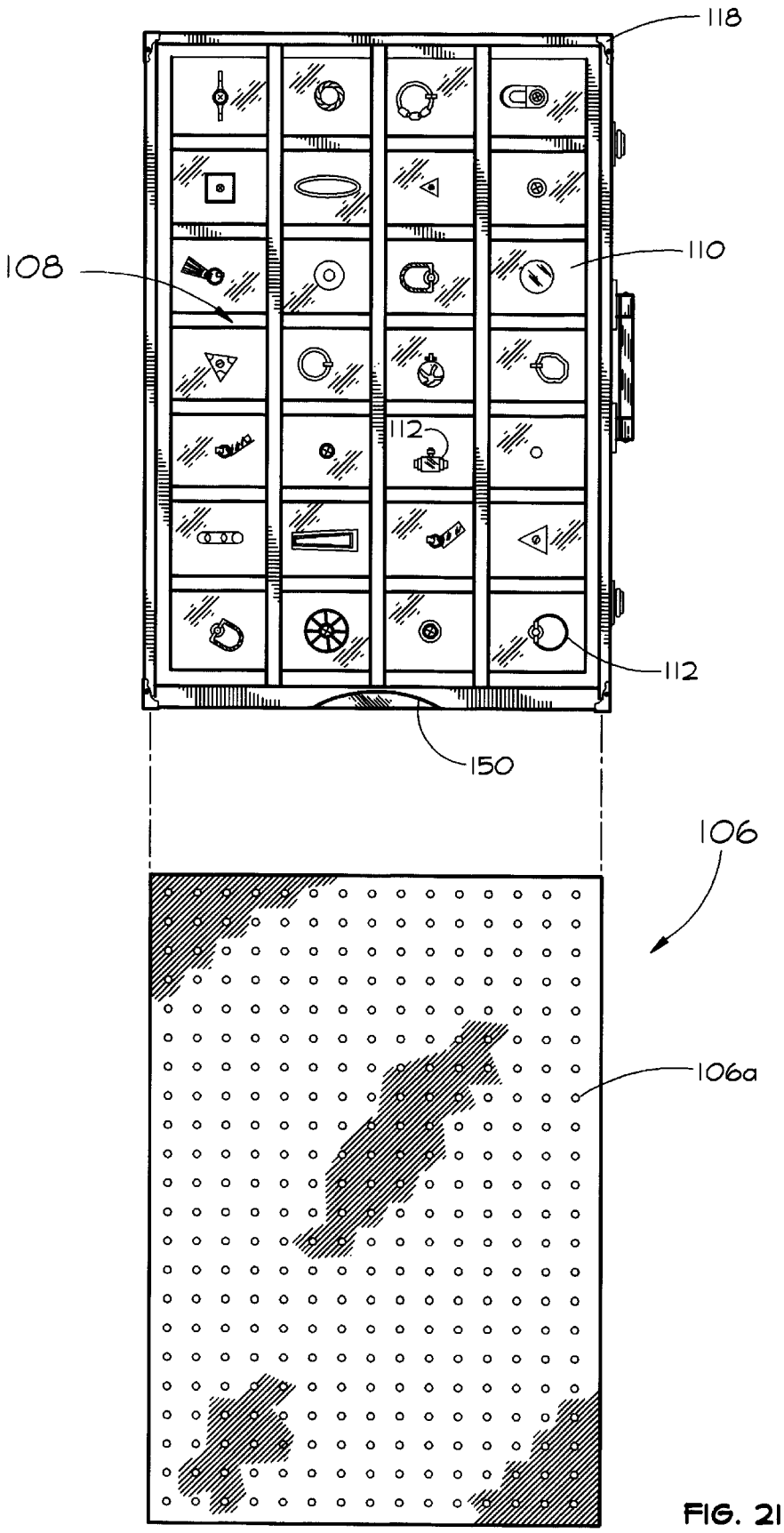
FIG. 21 is a top elevational view of the second section subassembly of FIG. 20 illustrating the sliding support surface (106) in an extended position along its sliding axis.
Figure 22:
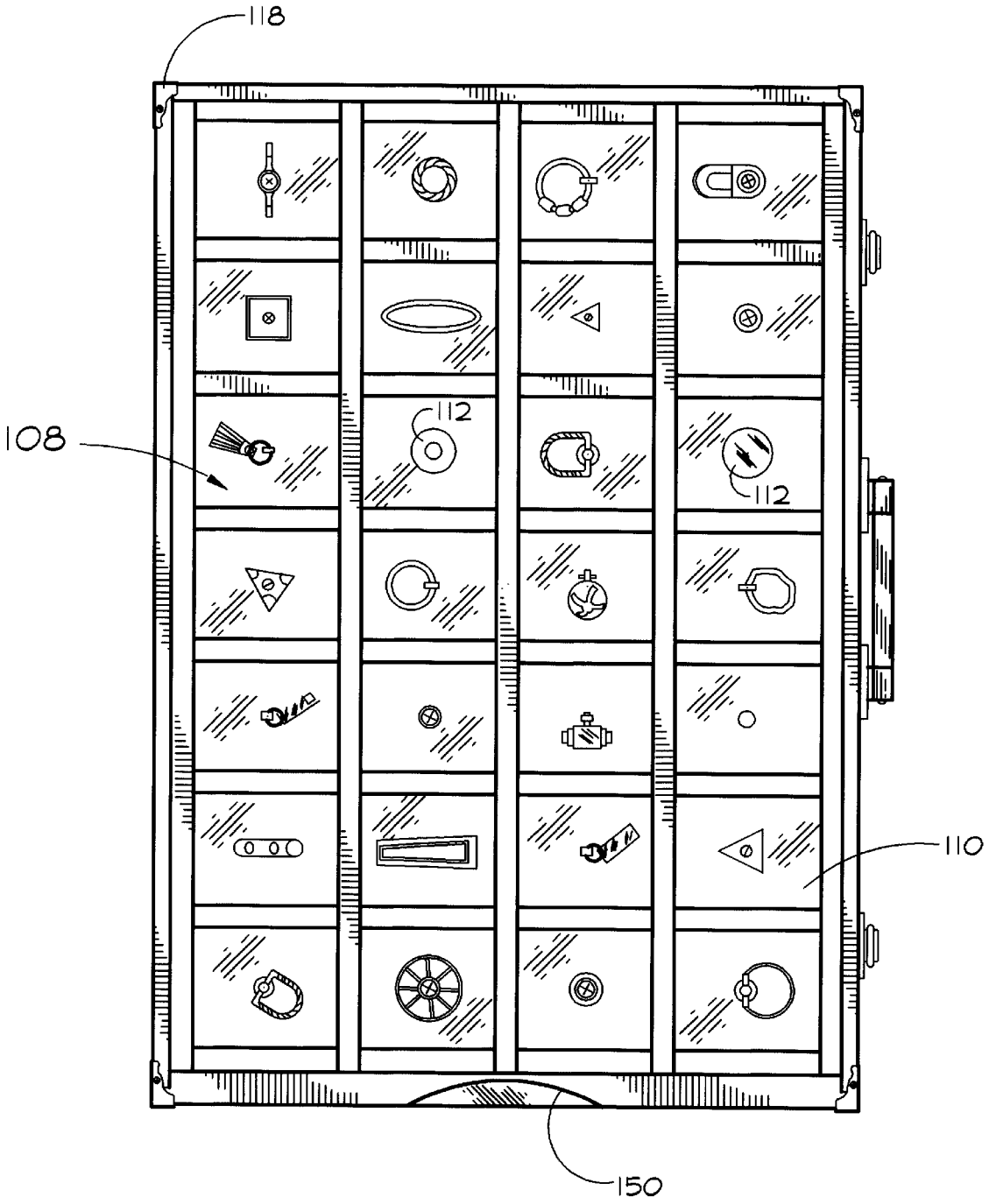
FIG. 22 is a top elevational view of the second section of FIG. 21 in an alternate partially opened condition.

The therapy assembly 10 is further provided with a pair of notched areas or portions: the fourth side member 22 of the sidewall support 14 of the first section subassembly 12, is provided with a first finger notch space portion 140, located generally adjacent to the first sliding means system 30 and the outside lengthwise surface 22*o;* and the fourth side member 89 of the shelf matrix 82 of the second section subassembly 80, is provided with a second finger notch space portion 150, located positionally adjacent to the sliding means 96 and the outside surface 89*o* of the fourth side member 89; each as illustrated in FIGS. 1 and 19, and other drawing figures.

Additionally, the therapy assembly 10 is further provided in a preferred embodiment with a prop and support-open system comprising the outside lengthwise surface 20*o* of the sidewall support 14 of the first section subassembly 12 having or defining a number or plurality of first selectable prop channels 160 generally along the same axis line (or in non-axial alignment), and the outside surface 87*o* of the third side member 87 of the shelf matrix 82 of the second section subassembly 80 having a plurality of second selectable prop channels 170 set generally along the same axis (or in different alignment). The therapy assembly 10 is further provided with a prop support member 180 which is inserted, and capable of release from, a selected first selectable prop channel 160 at one of its ends and a selected second selectable prop channel 170 at the other of its ends, for supporting the first section subassembly 12 and the second section subassembly 80 in a selected open position and/or at a selected open angle in relation to one another; all as illustrated by example in FIGS. 1, 2 and 18.

Figure 36:
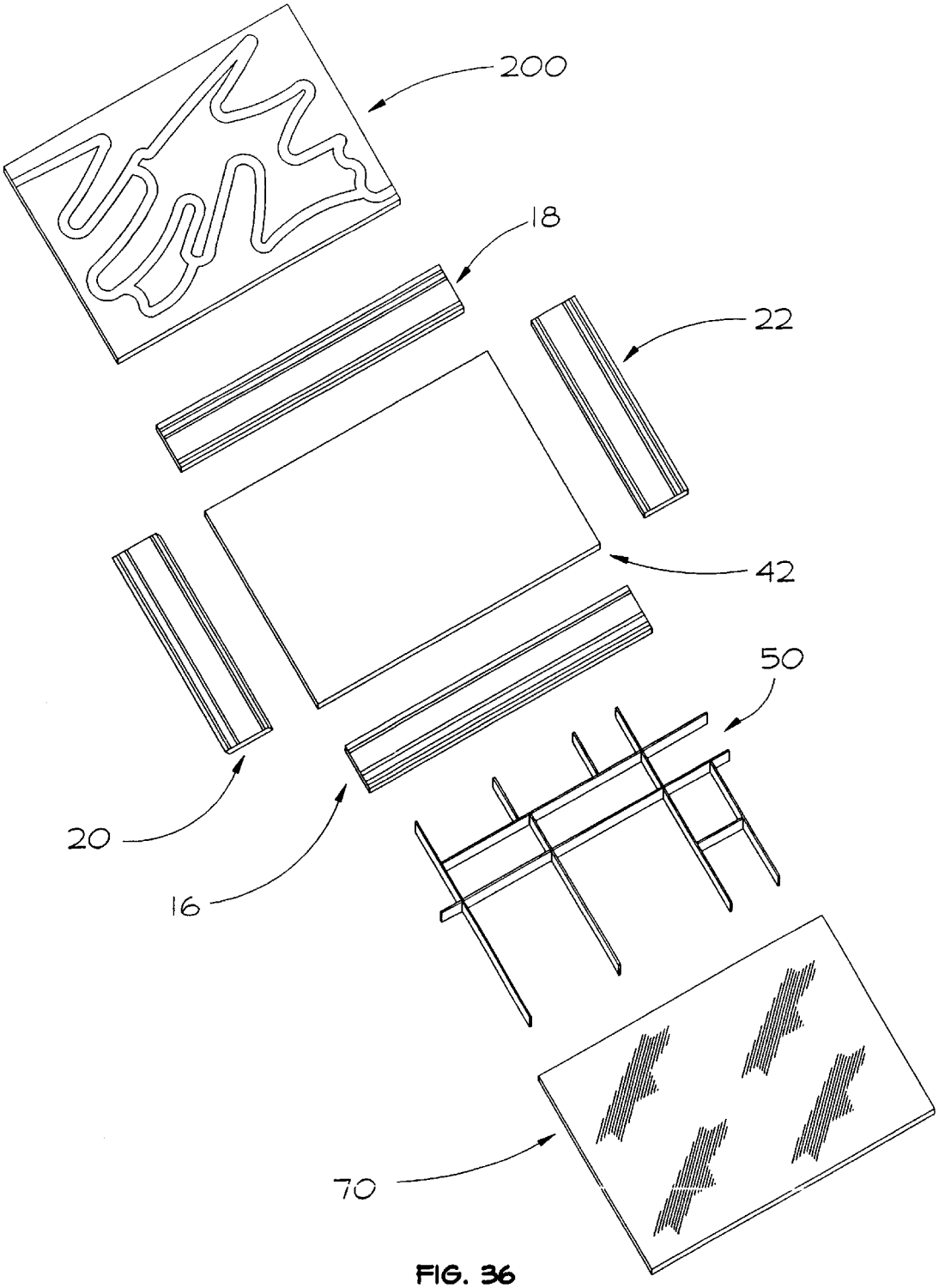
FIG. 36 is an exploded view of a preferred embodiment of the first section subassembly of the invention showing the inlay sheet (200) to be installed on the erasable board (42).

The therapy assembly 10 is further provided with at least one sliding symbolized sheet member portion 130, which can be preferably rectangular in configuration, as illustrated in FIG. 36, but which can be provided in many shapes and materials. The sliding sheet member portion 130 is inserted and slidably installed and positioned within the slotable means 102 of the second section subassembly 82; on, through and within relevant and adjacent portions of the sheet guide flange portions 102*a,* 102*b* and 102*c,* and the sheet insertion channel 102*d;* so that symbolized or descriptive sections or portions of the sheet member portion 130 register or can reasonably be seen, viewed or perceived through each or a selected group of door openings 108*a* when respective positionable door members 110 are pivoted or moved to an open and viewable position, per FIG. 34.

In preferred embodiments the therapy assembly is also provided with at least one symbolized and illustrated inlay sheet member 200 having designed or illustrated, drawn or written portions on at least one surface thereof. The inlay sheet member 200 is preferably dropped or placed in position for installed viewing by placing the sheet member 200 inboard or inside of the first transparent sliding member 40 of the sidewall support 14 so that it is secured between the erasable board member 42 and the first transparent sliding member 40 when the transparent sliding member 40 is in closed or installed position. In so doing, the designed and illustrated portions of the inlay sheet member 200 are viewable through the first transparent sliding member 40 when this member is in installed position, as illustrated generally in FIGS. 16, 17, 30, 33 and 36.

Accordingly, the appended claims are intended to cover all reasonable changes and modifications such as dimensions, materials used for construction and reasonable alternative or optional placement or position of slots, channels or holes and other members, with all such changes and modifications falling within the true reasonable scope and spirit of the present invention. The reader is, therefore, requested to determine the scope of the invention by the appended claims and their legal equivalents under the Patent Law, and not by the examples which have been given.

Obviously, many modifications and variations of the present invention are possible in light of the above teachings. It is, therefore, to be understood that within the scope of the appended claims, the invention may be practiced otherwise than as specifically described.

That which is claimed is:

1. A portable therapy case assembly for use with symbolized inlays and slidable sheets for testing and prompting selected skills and thinking of a user, said portable therapy case assembly comprising:

a first section subassembly, said first section subassembly comprising:

a generally rectangular sidewall support, having generally parallel first and second side members and third and fourth side members positioned and connected generally parallel to one another and transverse to said first and second side members, and defining therewithin a hollow outboard installation space, a hollow middle-portion space and a hollow inboard installation space, each coextensive vertically with one another, said sidewall support having a first sliding means proximal to the outboard installation space for receiving a sliding member, a means for securing a stationary member positioned between said first sliding means and the middle-portion space, and a second sliding means proximal to the inboard installation space for receiving a sliding member, a first transparent sliding member, being slidably engaged, installed and supported by said first sliding means, an erasable board member having first and second surfaces, being fixedly secured within said means for securing a stationary member, such that the first surface lies below and is viewable through said first transparent sliding member, a dividing means for providing storage space, being mounted adjacent to the second surface of said erasable board member within and adjacent to the middle-portion space and the inboard installation space, and a second transparent sliding member, being slidably engaged, installed and supported by said second sliding means, such that it slidably covers the dividing means; and a second section subassembly, said second section subassembly comprising:

a generally rectangular sidewall support, having generally parallel first and second side members and third and fourth side members positioned and connected generally parallel to one another and transverse to said first and second side members, and defining therewithin a hollow outboard installation space, a hollow middle-portion space and a hollow inboard installation space, each coextensive vertically with one another, said sidewall support having a sliding means positioned proximal to the outboard installation space for receiving a sliding member, first means for securing a stationary member positioned proximal to the middle-portion space, second means for securing a stationary member positioned below or under said first means between the middle-portion space and the inboard installation space, slotable means inboard of said second means for receiving a sliding symbolized sheet member and third means for securing a stationary member positioned adjacently between the slotable means and the inboard installation space, a sliding support surface defining a plurality of insertion installation holes, being slidably engaged, installed and supported on said sliding means of said second section subassembly, a door frame support member having an outboard surface and an inboard surface and having a plurality of movable doors mounted therebetween, being fixedly secured within said first means for securing a stationary member of said second section subassembly, each of said movable doors having a symbolized handle member;

a stationary transparent member, being fixedly secured within said second means for securing a stationary member of said second section subassembly such that it is adjacent to the inboard surface of said door frame support member, and a substantially solid and resistent inboard wall section panel, being fixedly secured in stationary position within said third means for securing a stationary member of said second section subassembly;

means for coupling said first section subassembly and said second section subassembly for positionable and securable interface therebetween; and a plurality of corner support members for reinforcing and supporting the connection of the first, second, third and fourth side members of said first section subassembly and the first, second, third and fourth side members of said second section subassembly.

2. The portable therapy case assembly of claim 1, wherein:

said second section subassembly further comprises at least one sliding symbolized sheet member, being inserted and slidably installed and positioned within said slotable means, and having symbolized portions thereon which register with each of said movable doors when said sheet member is in an installed position.

3. The portable therapy case assembly of claim 2, wherein:

the third side member of the rectangular sidewall support of said first section subassembly defines a finger notch space adjacent to said first sliding means; and the third side member of the rectangular sidewall support of said second section subassembly defines a finger notch space adjacent to said sliding means.

4. The portable therapy case assembly of claim 3, wherein:

said first section subassembly further comprises at least one symbolized and illustrated inlay sheet member having designed and illustrated portions on at least one surface thereof, said symbolized and illustrated inlay sheet member being installed inboard of said first transparent sliding member such that it is secured between the erasable board member and said first transparent sliding member when said first transparent sliding member is in installed position, the designed and illustrated portions of said inlay sheet being viewable through said first transparent sliding member when in installed position.

5. The portable therapy case assembly of claim 4, wherein:

said second section subassembly further comprises at least one sliding symbolized sheet member, being inserted and slidably installed and positioned within said slotable means of said second section subassembly, and having symbolized portions thereon on at least one side thereof which register with each of said movable doors when said sheet member is in an installed position.

6. A portable therapy case assembly for use with symbolized and illustrated inlay and slidable sheets for testing and prompting motor and cognitive skills of a user, for use as a therapy tool and a game, said portable therapy case assembly comprising:

a first section subassembly, said first section subassembly comprising:

a rectangular-like sidewall support frame having substantially parallel first and second side members and first and second end wall members positioned and connected substantially parallel to one another and transverse, respectively, to each of said first and second side members, each of said first and second side members and said first and second end wall members having inside and outside lengthwise surfaces, outboard and inboard widthwise surfaces and first and second connecting-end portions disposed substantially transverse and vertical to each of said respective outboard and inboard widthwise surfaces, each of said connecting-end portions being coupled respectively with each adjoining connecting-end portion of each respective first and second side members and said first and second end wall member, said rectangular-like sidewall support frame defining an installation space, spaced vertically between each of said outboard widthwise surfaces and each of said inboard widthwise surfaces and adjoining each of said respective inside lengthwise surfaces, thereby defining an outboard installation space, a middle-portion space and an inboard installation space vertically concurrent and coexstensive with one another, said sidewall support having a first sliding means proximal to and below each of said outboard withwise surfaces for receiving a sliding member, means for securing a stationary member proximal and inboard of said first sliding means, within the outboard installation space of said sidewall support frame, and a second sliding means proximal and outboard of the inboard widthwise surfaces, within the inboard installation space of said sidewall support frame, for receiving a sliding member, a first transparent sliding member, being slidably engaged, installed and supported by said first sliding means, an erasable board member having first and second surfaces, being fixedly secured and mounted in stationary position within said means for securing a stationary member, such that the first surface lies below and is viewable through said first transparent sliding member when the member is in an installed position, a dividing means for providing storage space, being mounted adjacent to the second surface of said erasable board member within and adjacent to the middle-portion space and the inboard installation space, a second transparent sliding member, being slidably engaged, installed and supported by said second sliding means, such that it can be slidably positioned to cover the dividing means; and a second section subassembly, said second section subassembly comprising:

a rectangular-like shelf matrix, having generally parallel first and second side members, and third and fourth side members positioned and connected generally parallel to one another and transverse to said first and second side members, each side member having inside and outside surfaces, and defining therewithin a hollow outboard installation space, middle-portion space and inboard installation space, each spatially coextensive vertically with one another, said shelf matrix having a sliding means positioned proximal to the outboard installation space for receiving a sliding member, first means for securing a stationary member positioned proximal to the middle-portion space, second means for securing a stationary member positioned proximal to, and inboard, below or under, said first means, and generally adjacent to the middle-portion space, slotable means, inboard of said second means, for receiving a sliding sheet member, and third means for securing a stationary member positioned adjacently inboard of the slotable means and generally within the inboard installation space, a sliding support surface defining a plurality of installation holes, said sliding support surface being slidably and positionally engaged, installed and supported on said sliding means of said shelf matrix for optional slidable attachment thereon and for utilization in a therapy or game context of items mounted on said installation holes, a door frame shelf support member having an outboard surface and an inboard surface, and having a plurality of positionable door members pivotably mounted therebetween, said door frame shelf support member being fixedly secured in stationary position on said first means for securing a stationary member of said shelf matrix, each of said positionable door members having a symbolized identification handle member for utilization of a user's skills in recognition thereof, a stationary transparent member, said member being fixedly secured on the second means for securing a stationary member of said shelf matrix, such that it is adjacent to the inboard surface of said door frame shelf support member, and a inboard wall panel, said panel being fixedly secured in stationary position on said third means for securing a stationary member of said shelf matrix;

means for hingably coupling said sidewall support frame of said first section subassembly with said shelf matrix of said second section subassembly;

support means adjacent to the outside surfaces of the first and second side members and first and second end wall members of said sidewall support frame, and adjacent to the outside surfaces of the first, second, third and fourth side members of said shelf matrix, for structural reinforcement thereof; and means mounted adjacent to the outside surface of the first side member of said shelf matrix for portably carrying and transporting said portable therapy case assembly.

7. The portable therapy case assembly of claim 6, wherein:

said first sliding means of the sidewall support frame of said first section subassembly comprises:

each of the inside lengthwise surfaces of said first and second side members defining a guide slot substantially parallel to one another along the same axis;

said first end wall member defining an insertion slot coaxial with the guide slots, extending between the inside and outside lengthwise surfaces thereof, for initial engagement and slotable and slidable installation of said first transparent sliding member; and the inside lengthwise surface of said second end wall member defining a stop-slot coaxial with the insertion slot and the guide slots, for receipt of said first transparent sliding member when slidably moved to an installed position.

8. The portable therapy case assembly of claim 7, wherein:

said means for securing a stationary member of the sidewall support frame of said first section subassembly comprises:

each of the inside lengthwise surfaces of said first and second side members proximal and inboard of said first sliding means, defining a side attachment slot substantially parallel to one another along the same axis; and each of the inside surfaces of said first and second end wall members defining a end attachment slot substantially parallel to each other and substantially parallel and concurrent with the axis of the side attachment slots;

said erasable board member being slotably inserted and fixedly attached to each of said side attachment slots and said end attachment slots such that said erasable board member is secured and mounted in a stationary position proximal and inboard of said first sliding means, and said first transparent sliding member when in a installed position.

9. The portable therapy case assembly of claim 8, wherein:

said second sliding means for receiving a sliding member of the sidewall support frame of said first section subassembly comprises:

each of the inside lengthwise surfaces of said first and second side members, proximal to and outboard of the inboard widthwise surfaces and within the inboard installation space of said sidewall support frame, defining a slidable slot substantially parallel to and coaxial with one another;

said second end wall member defining a installation slot extending between the inside and outside lengthwise surfaces thereof transverse to and coaxial with the slidable slots, for initial engagement and slidable installation of said second transparent sliding member; and the inside lengthwise surface of said first end wall member defining a end slot for slidable register and receipt of said seocnd transparent sliding member when said member is slidably moved to an installed position.

10. The portable therapy case assembly of claim 9, wherein:

said first transparent sliding member comprises a rectangular-like, resilient transparent sheet member having first and second surfaces coextensively spaced between first and second side sections and first and second end sections, the first and second side sections being guidably and slidably supported, respectively, by said guide slot of each inside lengthwise surface of said first and second side members of said side wall support frame, said first end section being supported when slidably positioned within the stop-slot of said inside lengthwise surface of said second end wall member, and said second end section being supported when slidably positioned within the insertion slot of said first end wall member.

11. The portable therapy case assembly of claim 10, wherein:

said erasable board member having first and second surfaces, comprises said first surface thereof having a surface which permits writing materials and implements to make a viewable impression thereupon which, after utilization, can be wiped and erased when so desired to make other viewable impressions, said erasable board member further comprises a rectangular-like configuration for fixed attachment to said side attachment slots and said end attachment slots of the means for securing a stationary member of said side wall support frame.

12. The portable therapy case assembly of claim 11, wherein:

said dividing means for providing storage space of the sidewall support frame of said first section subassembly, comprises a plurality of dividing section members positioned and attached parallel and transversely to one another, each of said dividing section members having an installation surface and at least one other surface, each of the installation surfaces being removably coupled to the second surface of said erasable board member such that each dividing section member is positioned adjoining the inside lengthwise surfaces and the middle-portion and inboard installation spaces of said sidewall support frame of said first section subassembly; and wherein:

said second transparent sliding member comprises a rectangular-like, resilient, generally transparent partition member having first and second surfaces spaced between first and second side portions and first and second end portions, the first and second side portions being positionably and slidably, slotable and movable within each respective slidable slot of the second sliding means of said first and second side members of the sidewall support frame, the first end portion being positionally guided and inserted within the end slot of said second sliding means, and the second end portion being guidable and positionally supportable by the installation slot of said second sliding means when said second transparent sliding member is so positioned.

13. The portable therapy case assembly of claim 12, wherein:

said sliding means of said shelf matrix of said second section subassembly, comprises:

each of the in side surfaces of the first, second and third side members defining a guide slot, the guide slots of the first and second side members being parallel and coaxial with one another and the guide slot of the third side member being transverse and coaxial with the guide slots of said first and second side members, and the fourth side member of said shelf matrix defining a insertion slot extending between the inside and outside surfaces of said fourth side member, said insertion slot being generally parallel to the guide slot of said third side member and coaxial with the guide slots of said first, second and third side members, for initial engagement and slotable and slidable interface of said sliding support surface.

14. The portable therapy case assembly of claim 13, wherein:

said first means for securing a stationary member of said shelf matrix of said second section subassembly, comprises:

each of the inside surfaces of the first, second, third and fourth side members of said shelf matrix defining a attachment slot each of which is generally coaxial with one another, the attachment slots of said first and second side members being generally parallel to one another and the attachment slots of said third and fourth side members being generally parallel with one another and generally transverse with the attachment slots of said first and second side members.

15. The portable therapy case assembly of claim 14, wherein:

said second means for securing a stationary member comprises attachment portions positioned on the inboard surface of said door frame shelf support member; and wherein:

said slotable means, inboard of said second means, of said shelf matrix, comprises:

each of the inside surfaces of said first, second and third side members defining a sheet guide flange portion generally coaxial with one another, the sheet guide flange portions of said first and second side members being generally parallel with one another and the sheet guide flange portion of said third side member being generally transverse positionally to the sheet guide flange portions of said first and second side members, and the fourth side member of said shelf matrix defining a sheet insertion channel extending from the inside surface to the outside surface of said fourth member and being coaxial with the sheet flange portions of said first, second and third side members, for slidable insertion, register and guidance of a sliding sheet member.

16. The portable therapy case assembly of claim 15, wherein:

said third means for securing a stationary member of said shelf matrix, comprises:

each of the inside surfaces of said first, second, third and fourth side members defining a inboard wall attachment channel, each of the inboard wall attachment channels being generally coaxial with one another, the inboard wall attachment channels of said first and second side members being generally parallel with one another and the inboard wall attachment channels of said third and fourth side members being generally parallel with one another and transversely positioned to the inboard wall attachment channels of said first and second side members.

17. The portable therapy case assembly of claim 16, wherein:

said door frame shelf support member further comprises a plurality of frame units, each having at least one dowel support member and one door post portion, each of said dowel support member defining a dowel hinge installation channel, and each of said positionable door members defining at least one dowel support channel;

and wherein:

said door frame shelf support member further comprises a plurality of dowel members, each of which is received within each of said frame units, installed in the respective dowel support channel and dowel hinge installation channel for pivotable support of each of the positionable door members in each respective frame unit.

18. The portable therapy case assembly of claim 17, wherein:

the outside lengthwise surface of the first end wall member of said sidewall support of said first section subassembly defines a plurality of first selectable prop channels, and the outside surface of the third side member of said shelf matrix of said second section subassembly defines a plurality of second selectable prop channels;

and wherein:

said portable therapy case assembly further comprises a prop support member having at least first and second ends, said prop support member being releasably and positionably installed at either of said ends of said prop support in one of said first selectable prop channels and one of said second selectable prop channels, respectively, for supporting the first and second section subassemblies in a selected open position and at a selected angle in reference to one another.

* * * * *